US007516772B2

(12) United States Patent
Matsuura et al.

(10) Patent No.: US 7,516,772 B2
(45) Date of Patent: Apr. 14, 2009

(54) METHOD OF FORMING A PRODUCT OF METAL-BASED COMPOSITE MATERIAL

(75) Inventors: Satoshi Matsuura, Sayama (JP); Hiroto Shoji, Sayama (JP); Takaharu Echigo, Sayama (JP); Masashi Hara, Sayama (JP); Hiroki Takano, Sayama (JP); Yusuke Toyoda, Wako (JP); Katsuhiro Shibata, Wako (JP); Takahiro Mizukami, Wako (JP); Hirohide Shibata, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/572,852

(22) PCT Filed: Dec. 27, 2004

(86) PCT No.: PCT/JP2004/019814

§ 371 (c)(1),
(2), (4) Date: Dec. 7, 2006

(87) PCT Pub. No.: WO2005/068106

PCT Pub. Date: Jul. 28, 2005

(65) Prior Publication Data

US 2007/0090154 A1 Apr. 26, 2007

(30) Foreign Application Priority Data

Jan. 20, 2004 (JP) ..... 2004-012381

(51) Int. Cl.
*B22D 17/12* (2006.01)
*B22D 19/02* (2006.01)
*B22D 19/14* (2006.01)

(52) U.S. Cl. ..... 164/97; 164/113; 164/312; 164/900

(58) Field of Classification Search ..... 164/113, 164/97, 98, 312, 900
See application file for complete search history.

(56) References Cited

U.S. PATENT DOCUMENTS

| | | | | |
|---|---|---|---|---|
| 4,473,103 | A * | 9/1984 | Kenney et al. | 164/97 |
| 6,240,827 | B1 * | 6/2001 | Koike et al. | 92/213 |
| 6,250,364 | B1 * | 6/2001 | Chung et al. | 164/97 |
| 2001/0039710 | A1 * | 11/2001 | Nakao et al. | 29/417 |

(Continued)

FOREIGN PATENT DOCUMENTS

| | | |
|---|---|---|
| JP | 63-199839 | 8/1988 |

(Continued)

*Primary Examiner*—Kuang Lin
(74) *Attorney, Agent, or Firm*—Kratz, Quintos & Hanson, LLP

(57) ABSTRACT

A forming method wherein a billet (31, 66, 77, 87, 107, 128, 136, 144, 153, 77B, 77C) comprising a metal-based composite material (27) prepared by mixing an aluminum alloy (22) and a ceramic (15) is subjected to pressure forming to manufacture a formed article, which comprises carrying out the pressure forming by the use of different compression ratios for different portions of the formed article, wherein a compression ratio means the ratio of the height of a billet before the pressure forming to height of the billet after the pressure forming. The above forming method allows the manufacture of a formed article having different volume contents 8Vf) of the ceramic for different portions thereof.

10 Claims, 27 Drawing Sheets

U.S. PATENT DOCUMENTS

2006/0021728 A1 * 2/2006 Gadow et al. ..... 164/80

FOREIGN PATENT DOCUMENTS

| | | | |
|---|---|---|---|
| JP | 1-240633 | | 9/1989 |
| JP | 2-115340 | | 4/1990 |
| JP | 2-220760 | * | 9/1990 |
| JP | 10-288085 | | 10/1998 |
| JP | 2001-316740 | | 11/2001 |
| JP | 2002-66724 | * | 3/2002 |
| JP | 2003-193168 | | 7/2003 |

* cited by examiner

METHOD OF FORMING A PRODUCT OF METAL-BASED COMPOSITE MATERIAL

TECHNICAL FIELD

Present invention relates to a method of forming a product of a metal-based composite material having a ceramic volume content differing from one portion to another by pressure forming a billet of the metal-based composite material.

BACKGROUND ART

There is a manufacturing method employing a metal-based composite material for raising the strength of a specific portion of a product. For example, Japanese Patent Laid-Open Publication JP-A-2001-316740 discloses a method of manufacturing a pulley which employs a metal-based composite material for any portion requiring strength, while using an ordinary metal for any other portion not requiring high strength, in order to achieve strength and a reduction in production cost. This method of manufacturing a pulley will be described with reference to FIG. 21 hereof.

The pulley 301 shown in FIG. 21 has a hub 302 formed from a composite material in its center, an aluminum alloy disk 303 formed integrally with the hub 302 and a grooved portion 305 fitted about the disk 303 with a shock absorbing member 304 held therebetween, and the hub 302 of high strength can bear a bolt tightening force applied for attaching the pulley 301 to a shaft.

The method of manufacturing the pulley 301 is started by extrusion molding a composite material into a cylinder and cutting the cylinder to form the hub 302. Then, the hub 302 is set in a pulley casting mold and the mold is filled with a molten aluminum alloy.

The method of manufacturing a pulley as described, however, requires a great deal of time and labor, since it requires steps for making two parts separately, i.e. the hub 302 of a composite material and the aluminum alloy disk 303. The step of forming the hub 302 of a composite material and the step of casting the aluminum alloy disk 303 have both the drawback of involving a complicated job and requiring a great deal of time and labor.

A method of manufacturing a composite material having an improved cooling property by using a metal-based composite material is disclosed in, for example, Japanese Patent Publication JP-A-2002-66724. This manufacturing method is an art characterized by pressing a block of a metal-based composite material in a press to separate the matrix and reinforcing material in the metal-based composite material from each other and thereby situate the reinforcing material in a pattern lacking uniformity, so that the thermal conductivity of the reinforcing material situated in a pattern lacking uniformity may improve the cooling property of the product. The method of manufacturing the composite material will now be described with reference to FIGS. 22A, 22B and 22C hereof.

A product 311 formed from a composite material as shown in FIG. 22A includes a base portion 312 and a plurality of fins 313 formed on a surface of the base portion 312.

Firstly, a metal-based composite material 314 is produced from an aluminum alloy 315 and fine particles 316 of silicon carbide and the metal-based composite material 314 as produced is used to form a block 317, as shown in FIG. 22B. Secondly, the block 317 is heated, placed in a mold 318 (having cavities 319 for fins) and compressed.

When it is compressed as shown in FIG. 22C, the aluminum alloy 315 flows into the cavities 319 for fins and forms aluminum alloy fins 313.

According to the method of manufacturing the composite material as described, however, fine particles of silicon carbide cannot be put in the fins 313 adequately, but the fins 313 are only of the aluminum alloy and too low in strength, though a certain amount of time and labor can be saved. In other words, it is impossible to have silicon carbide distributed in the center of the fins 313 to achieve any desired volume content and as a result, it is difficult to rely on the strength of the composite material.

Therefore, there is a desire for an art which facilitates the manufacture of a product of a metal-based composite material having a ceramic volume content differing from one portion to another.

DISCLOSURE OF THE INVENTION

According to present invention, there is provided a method of forming a product of a metal-based composite material, characterized by comprising the step of preparing a billet of a metal-based composite material by mixing a metal matrix and a ceramic reinforcing material, the step of heating the billet to a specific temperature and the step of pressure forming the heated billet in a die assembly, so that the billet may have a compression ratio H/h1 differing from one portion of the formed product to another to give the formed product a ceramic volume content differing from one portion to another, where H is the height of the billet prior to forming and h1 is its height after forming.

When a billet is pressure formed, its compression ratio is varied from one portion to another to give it a different degree of forming strain from one portion to another and thereby give a formed product a ceramic volume content differing from one portion to another. This advantageously makes it possible to facilitate the manufacture of a product formed from a metal-based composite material and having a ceramic volume content differing from one portion to another.

The billet preferably has a height varying from one portion to another. Thus, the mere closure of the die assembly makes it possible to give a formed product a ceramic volume content varying from one portion to another, thereby facilitating a forming job giving it a ceramic volume content varying from one portion to another.

The pressure forming preferably employs a split die assembly. Thus, the split sections of the die assembly permit individual pressure control and pressure is first applied to the die section corresponding to any product portion for which a high ceramic volume content is desired. Then, pressure is applied to any remaining die section corresponding to any remaining product portion. This advantageously makes it possible to form a multiplicity of product portions differing in ceramic volume content from one another.

The pressure forming preferably employs a die assembly having heat insulation in its portions contacting the billet. This advantageously makes it possible to reduce any difference in the ceramic volume content of the material between the surface and deep layers of the formed product as compared with the case in which no control is made of the thermal conductivity of any portion contacting the billet.

An aluminum alloy is preferably employed as the matrix, and an alumina aggregate as the ceramic. Thus, a metal-based composite material is easy to prepare, since it is sufficient to mix a molten aluminum alloy and alumina aggregate and an alumina aggregate is easy to prepare, and it is possible to improve the production efficiency of any product having a ceramic volume content differing from one portion to another.

The step of heating is preferably carried out for heating the billet to or above 580° C. to raise the fluidity of the metal matrix.

BEST MODE OF CARRYING OUT THE INVENTION

Figure 1A:
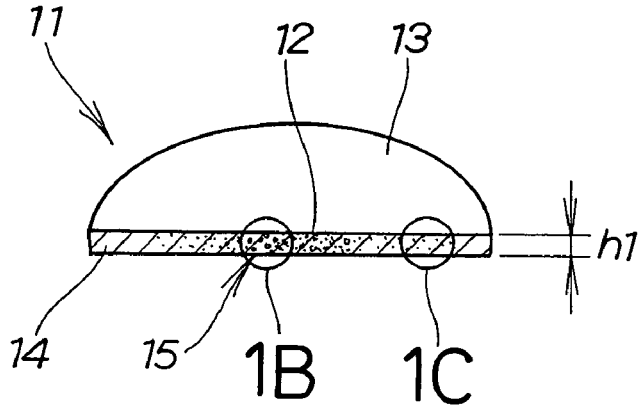
FIGS. 1A to 1C are diagrams showing a first product of a metal-based composite material formed by a first forming method according to the present invention.
Figure 1B:
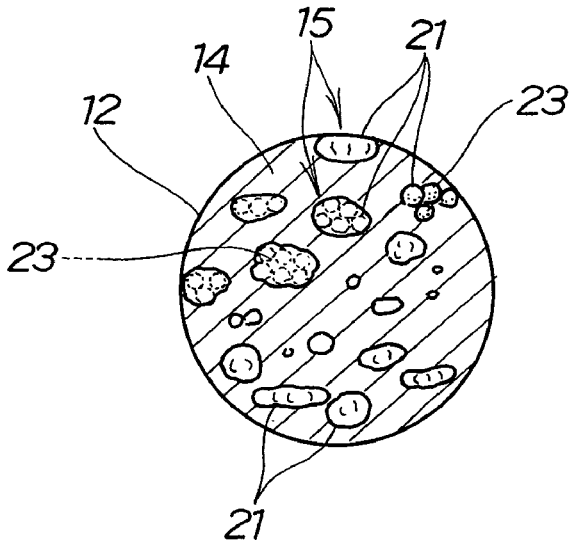
Figure 1C:
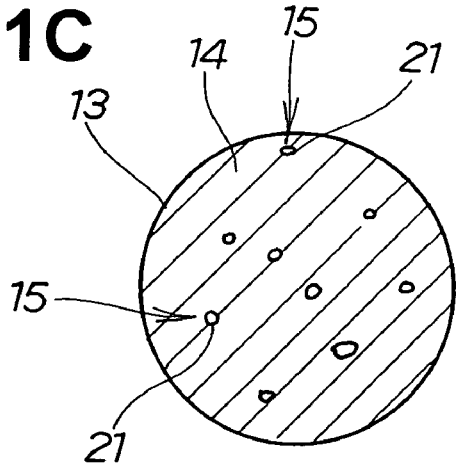

FIGS. 1A to 1C show a first product of a metal-based composite material formed by a first forming method according to present invention.

The first product 11 shown in FIG. 1A is a product formed from a metal-based composite material and is used as, for example, a part of an automobile or a part of an industrial machine.

The first product 11 is a disk-shaped sheet material having a middle portion 12 and an edge portion 13 connected to the middle portion 12. The middle portion 12 is higher in strength than the edge portion 13. Thus, the first product 11 ensures strength and also achieves a weight reduction when its edge portion 13 is intended for any portion not requiring much strength, and its middle portion 12 for any portion requiring strength.

h1 stands for the height of a billet as worked on, which corresponds to the sheet thickness.

The first product 11 is made of a metal-based composite material composed of a metal 14 and a ceramics 15.

The middle portion 12 is a portion containing about 40% of ceramics 15 in the metal 14, as shown in FIG. 1B. An aluminum alloy was used as the metal 14. The ceramics 15 is, for example, an alumina aggregate 21.

When the ceramic volume content is expressed as Vf, the ceramic volume content Vf (%) can be obtained as (Volume of ceramics/(Volume of matrix+Volume of ceramics))×100.

The ceramic volume content Vf of the middle portion 12 is Vm1 (about 40%). The corresponding Young's modulus is expressed as Em1.

The edge portion 13 shown in FIG. 1C is a portion containing about 18% of ceramics 15 in the metal 14.

The ceramic volume content Vf of the edge portion 13 is Ve1 (about 18%). The corresponding Young's modulus is expressed as Ee1 and Young's modulus Ee1 is <Em1. Thus, the ceramic volume content Vf of the first product 11 decreases gradually from its middle portion 12 to its edge portion 13. Accordingly, the Young's modulus of the first product 11 decreases gradually from its middle portion 12 to its edge portion 13.

A first method of forming a first product 11 of a metal-based composite material as described above will now be described with reference to FIGS. 2A to 21. The first forming method has the step of preparing a composite material, the step of forming a billet, the step of heating the billet and the step of pressure forming it. These four steps will be described one by one more specifically.

FIGS. 2A to 2D show the steps of preparing a composite material and forming a billet in the first forming method.

Figure 2A:
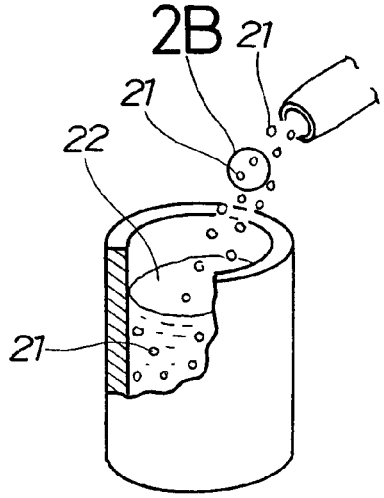
FIGS. 2A to 2I are diagrams showing the steps of manufacturing a composite material, the step of forming a billet, the step of heating it and the step of pressure forming it in the first forming method according to the present invention.

Referring to FIG. 2A, the step of preparing a composite material makes a metal-based composite material by mixing a matrix and ceramics. More specifically, an aluminum alloy 22 was employed as the matrix. A6061 according to the Japanese Industrial Standard (JIS) was used as the aluminum alloy 22. An alumina aggregate 21 was used as the ceramics.

Figure 2B:
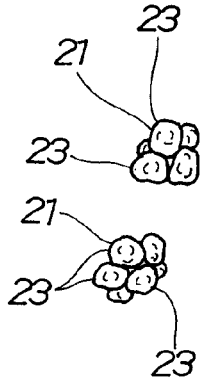

FIG. 2B is an enlarged view of part 2B in FIG. 2A and schematically shows particles of the aggregate 21. Each particle of the aggregate 21 is a mass of alumina ($Al_2O_3$) particles 23. The aggregate 21 has a diameter of about 50 μm. The alumina ($Al_2O_3$) particles 23 had a diameter of about 1 μm.

Ceramics other than alumina ($Al_2O_3$) particles can be employed, too.

Although the first forming method employed the aggregate, it is also possible to use a powder not forming any aggregate.

Carbon fibers (long or short fibers) can be mentioned as a reinforcing material other than ceramics.

A given weight of aluminum alloy 22 is first melted and a given weight of aggregate 21 is placed in the molten aluminum alloy 22 and stirred therewith, as shown in FIG. 2A. The aluminum alloy 22 as stirred is placed in an appropriately shaped and sized ingot mold 24 (see FIG. 2C) and solidified to give a block of a metal-based composite material 27 (see FIG. 2C).

Figure 2C:
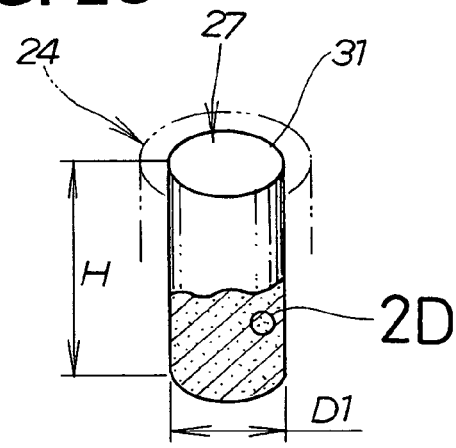

Referring to FIG. 2C, the step of forming a billet employs as a first billet 31 the block of the metal-based composite material 27 as solidified. H denotes the height of the billet yet to be pressed and D1 denotes its diameter.

The block of the metal-based composite material 27 may be worked on by, for example, cutting into a plurality of billets and into an adequate shape, depending on the billet shape and the ingot mold.

Figure 2D:
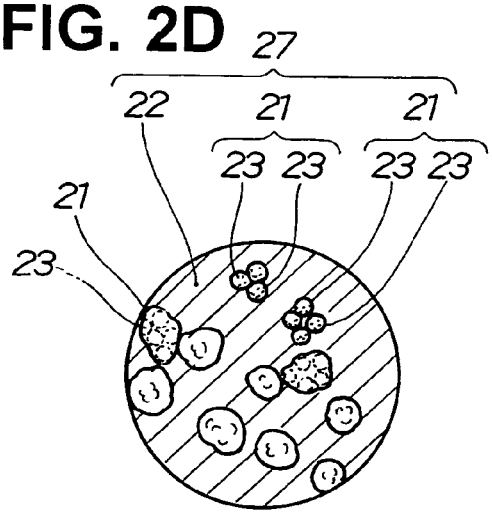

FIG. 2D is an enlarged view of part 2D in FIG. 2C and schematically shows the metal-based composite material 27. The metal-based composite material 27 is composed of the aluminum alloy 22 and the aggregate 21 of alumina particles 23.

The metal-based composite material 27 has a ceramic volume content Vf expressed as Vb (about 23 to 24%). The metal-based composite material 27 has a Young's modulus expressed as Eb.

The first forming method employing the aluminum alloy 22 as the matrix and the alumina aggregate 21 as the ceramics does not require a great deal of time and labor, since it is sufficient to mix the molten aluminum alloy 22 and the alumina aggregate 21. The alumina aggregate 21 is easy to prepare. Thus, to manufacture a metal-based composite material 27 is easy and it is possible to improve the production efficiency of any product having a ceramic volume content differing from one portion to another.

After the metal-based composite material 27 is prepared as the first billet 31 (see FIG. 2C), the step of heating the billet is started.

FIGS. 2E to 2I show the steps of heating the billet and pressing it according to the first forming method.

Figure 2E:
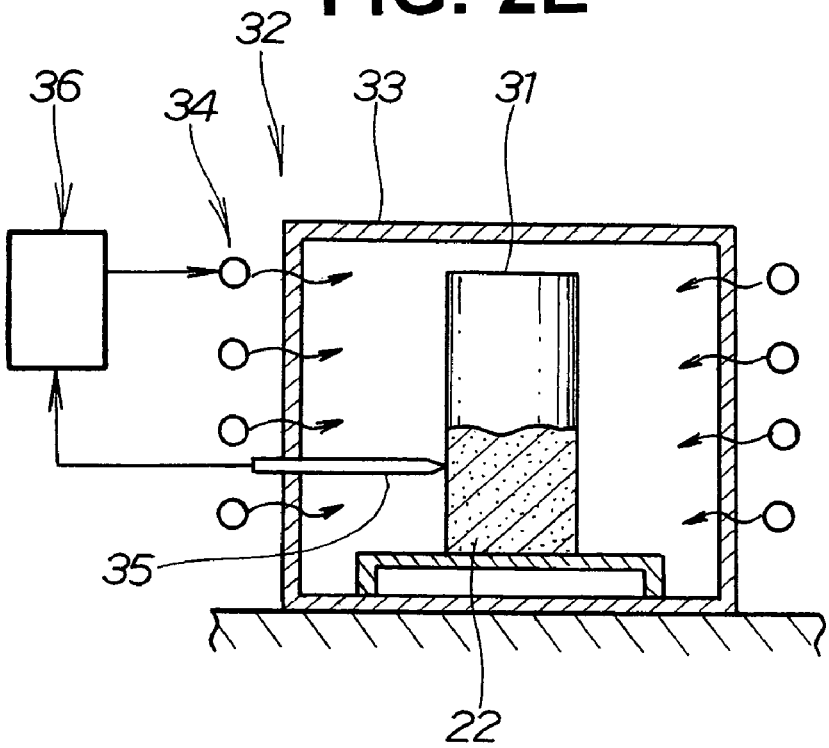

The step of heating the billet as shown in FIG. 2E heats the first billet 31 under specific temperature conditions in a heating furnace 32. The heating furnace 32 has a furnace body 33, a heat source 34, a thermocouple 35 and a control unit 36 for controlling the heat source 34 in accordance with the information from the thermocouple 35 and the pre-set conditions.

The specific temperature employed as the temperature conditions for the step of heating the billet is a temperature equal to or above the solidus of the aluminum alloy 22 (for example, 580° C. or above according to A6061 of the Japanese Industrial Standard).

Although the billet heating temperature may have its upper limit selected as desired, it is desirable to set its upper limit at an appropriate temperature based on production efficiency and quality considering that too high a temperature may prolong the subsequent solidifying step, and that more than necessary heating may prolong the heating step.

Figure 2F:
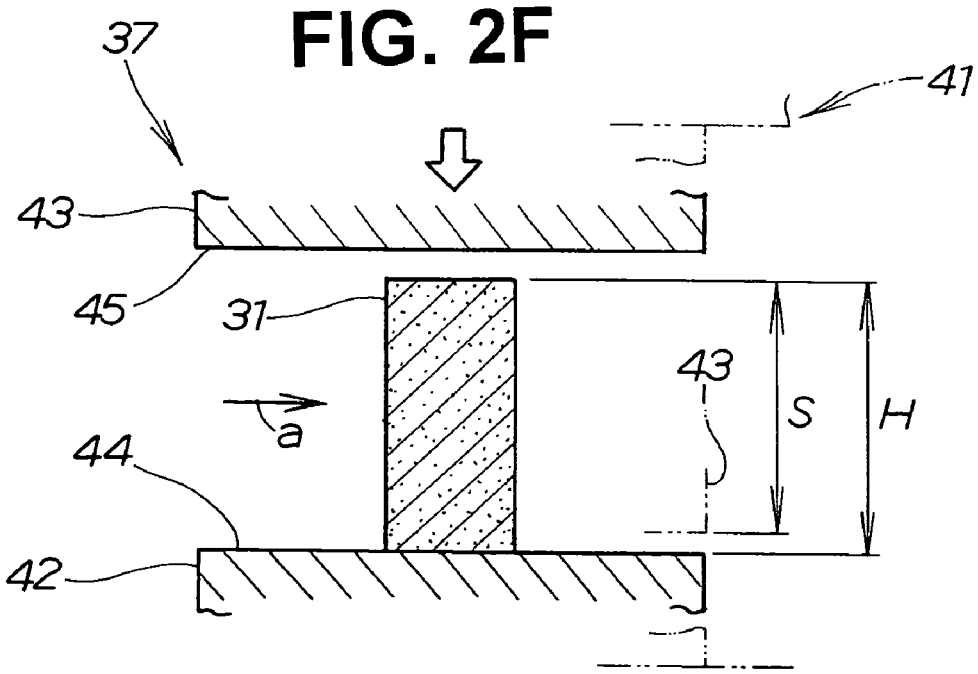

During the pressing step shown in FIG. 2F, the first billet 31 heated to or above 580° C. during the heating step is set in a die assembly 37 as shown by an arrow a, and formed into a specific shape by the operation of a press 41 in which the die assembly 37 is mounted.

The die assembly 37 is composed of a lower die 42 and an upper die 43 and has a temperature control device not shown. Both the lower and upper dies 42 and 43 have flat die surfaces 44 and 45, respectively. The die assembly 37 is of the upsetting type compressing the first billet 31 axially (in the direction of a white arrow) and expanding it laterally. The shape and construction of the die assembly 37 shown in the drawing are merely illustrative.

The temperature control device may be of any type and may, for example, be so constructed as to rely on a fluid or electricity for temperature control. A temperature of 300° C. is, for example, set. It is desirable to hold a die temperature of 300° C., but it is also possible to perform forming by using the die assembly at normal temperature without furnishing it with any temperature control device.

The principal forming conditions set in an operating panel (not shown) for the press 41 are a pressure P, a pressure applying velocity Vp and a descending stroke S. The pressure P is expressed by a surface pressure ($kg/cm^2$) against the projected area of the billet. The descending stroke S is the distance from the position where the die contacts the billet, to its lower limit, and is based on the thickness of a sheet formed by pressure application (the height h1 of the billet as obtained after pressure application).

Thus, the die assembly 37 is used to apply pressure to the first billet 31 at or above 580° C. with the pressure P, the pressure applying velocity Vp and the specific descending stroke to form the first product.

Figure 2G:
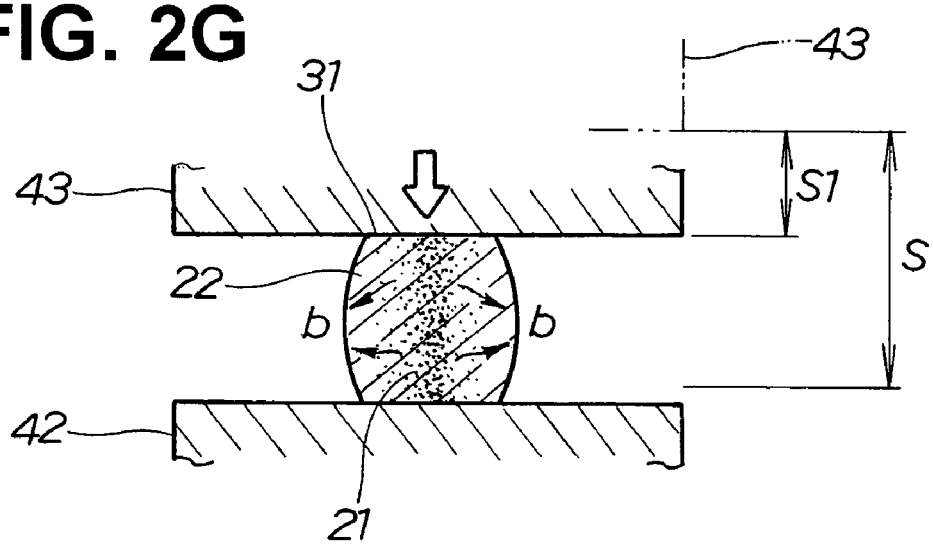
Figure 2H:
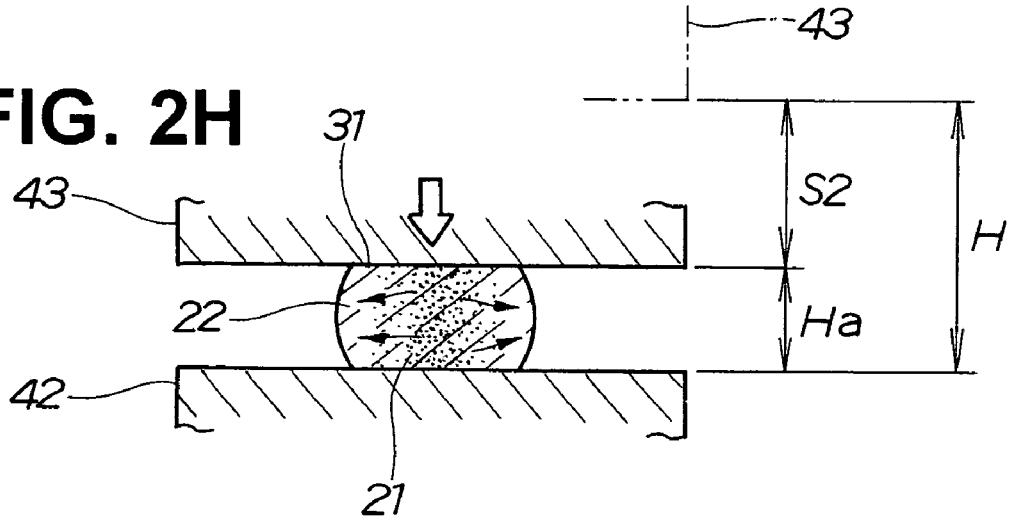
Figure 2I:
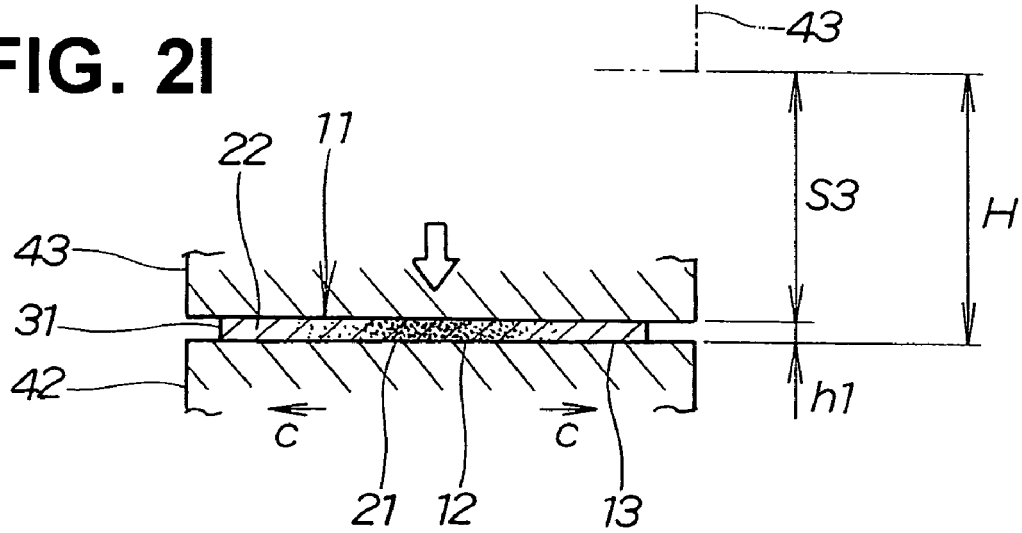

FIGS. 2G to 2I show the pressure being applied to the first billet 31.

The application of pressure to the first billet 31 is continued for the descending stroke S1 with the pressure P and pressure applying velocity Vp, as shown in FIG. 2G. During the process covering the descending stroke S1, the aluminum alloy 22 as the matrix having its fluidity improved at or above 580° C. begins to collapse under pressure and also begins to flow laterally outwardly (to the right and left in the drawing and to the front and rear in the drawing) as shown by arrows b. On the other hand, the particles of the aggregate 21 hardly move laterally outwardly, but begin to move down.

The upper die 43 continues to descend and when it has covered the descending stroke S2 (S2>S1) as shown in FIG. 2H, the height of the first billet 31 changes from H to Ha. During the coverage of the descending stroke S2, the aluminum alloy 22 further flows laterally outwardly through among the particles of the aggregate 21. The aggregate 21 begins to be destroyed by the contact and impingement of the particles thereof and begins to turn into a smaller aggregate or alumina ($Al_2O_3$) particles.

It further continues to descend, and as soon as it covers the descending stroke S3 defining its lower limit, a first product 11 is formed, as shown in FIG. 2I.

During the process covering the descending stroke S3, the aluminum alloy 22 continues to flow outwardly, the particles of the aggregate 21 collapse under pressure and turn into a smaller aggregate or alumina ($Al_2O_3$) particles and nearly all of those particles stay in the middle portion 12 of the first product 11 as formed by the central portion of the first billet 31, while the remainder are pushed by the aluminum alloy 22 flowing outwardly and flow laterally outwardly (in the directions of arrows c, c). As a result, the middle portion 12 of the first product 11 has its ceramic volume content Vf raised to Vm1 (about 40%) and exhibits the Young's modulus Em1, and the edge portion 13 of the first product 11 has its ceramic volume content Vf lowered to Ve1 (about 18%) and exhibits the Young's modulus Ee1.

The ceramic volume contents of the first product 11 from its edge portion 13 to its middle portion 12 are Ve1<Vb <Vm1, as compared with the ceramic volume content Vb of the metal-based composite material 27 (see FIG. 2D).

When the compression ratio is expressed as Rh, the compression ratio Rh in the case of the shape of the first product 11 is the compression ratio of its middle portion 12, or approximately the ratio between the dimensions of the billet prior to working and thereafter within its diameter D1 (see FIG. 2C). The compression ratio Rh of the middle portion 12 is expressed as Rh= H/h1, for example, 6.8. The compression ratio Rh of the portion other than the middle portion 12, or the compression ratio Rh of the edge portion 13 is expressed as Rh =0/h1, or its compression ratio Rh is not set.

According to the first forming method, therefore, the compression ratio Rh of the first product 11 differs from its middle portion 12 to its edge portion 13.

Figure 3:
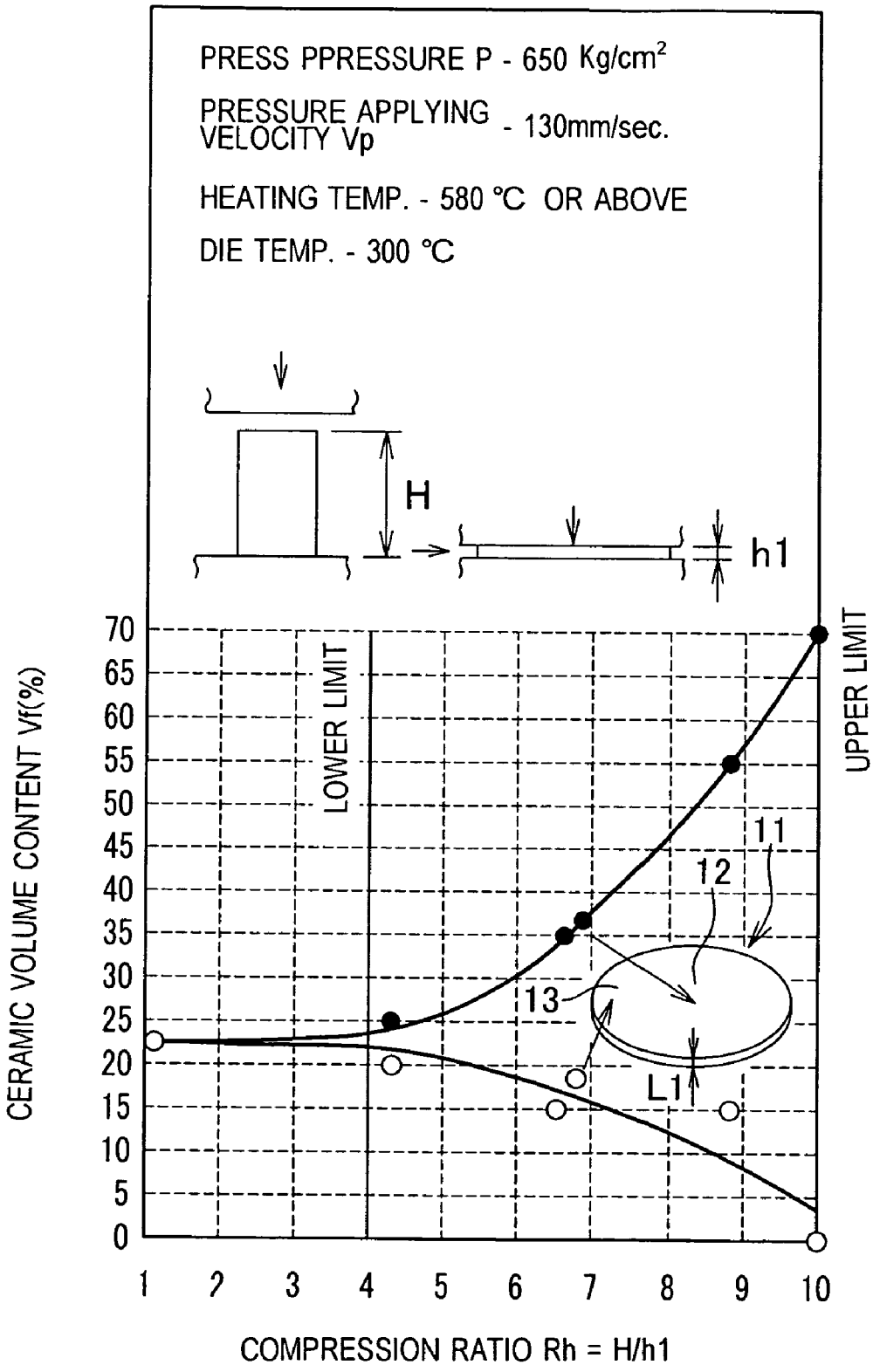
FIG. 3 is a graph showing the relation between the compression ratio in the first forming method and the ceramic volume content of the first product.

FIG. 3 is a graph showing the relation between the compression ratio by the first forming method and the ceramic volume content of the first product. The horizontal axis represents the compression ratio Rh of the middle portion and the vertical axis represents the ceramic volume content Vf. The forming conditions are a pressure P of 650 kg/cm$^2$ as expressed by the surface pressure against the projected area of the billet, a pressure applying velocity Vp of about 130 mm/sec., a heating temperature of 580° C. or above and a die temperature of 300° C.

● indicates the ceramic volume content Vf of the middle portion 12 of the first product 11.

○ indicates the ceramic volume content Vf of the edge portion 13 of the first product 11.

The ceramic volume content Vf of the middle portion 12 increases substantially in proportion to an increase in compression ratio Rh. The ceramic volume content Vf of the edge portion 13 decreases substantially in proportion to the increase in compression ratio Rh.

In other words, the ceramic volume content Vf of the edge portion 13 decreases with an increase in the ceramic volume content Vf of the middle portion 12. Thus, the control of the compression ratio Rh makes it possible to control the ceramic volume content Vf.

In the forming method of present invention, the compression ratio Rh is set in the range of 1 to 10. It is preferably set at 2 or above. The compression ratio of 2 or above makes it easy to realize a gradual decrease or increase in the ceramic volume content Vf of the product.

The compression ratio Rh below 2 makes it difficult to realize a gradual decrease or increase in the ceramic volume content Vf of the product.

If the compression ratio Rh is over 10, it is likely that any billet heated to a temperature equal to or above the solidus (for example, 580° C. or above according to JIS A6061) may collapse or fall down when placed in the die assembly, resulting in the failure to form any product, mainly when the billet is in the shape of a circular column. There are, however, billets so shaped as not to collapse or fall down even at a compression ratio Rh over 10 and a compression ratio Rh over 10 may be selected for those billets.

Figure 4:
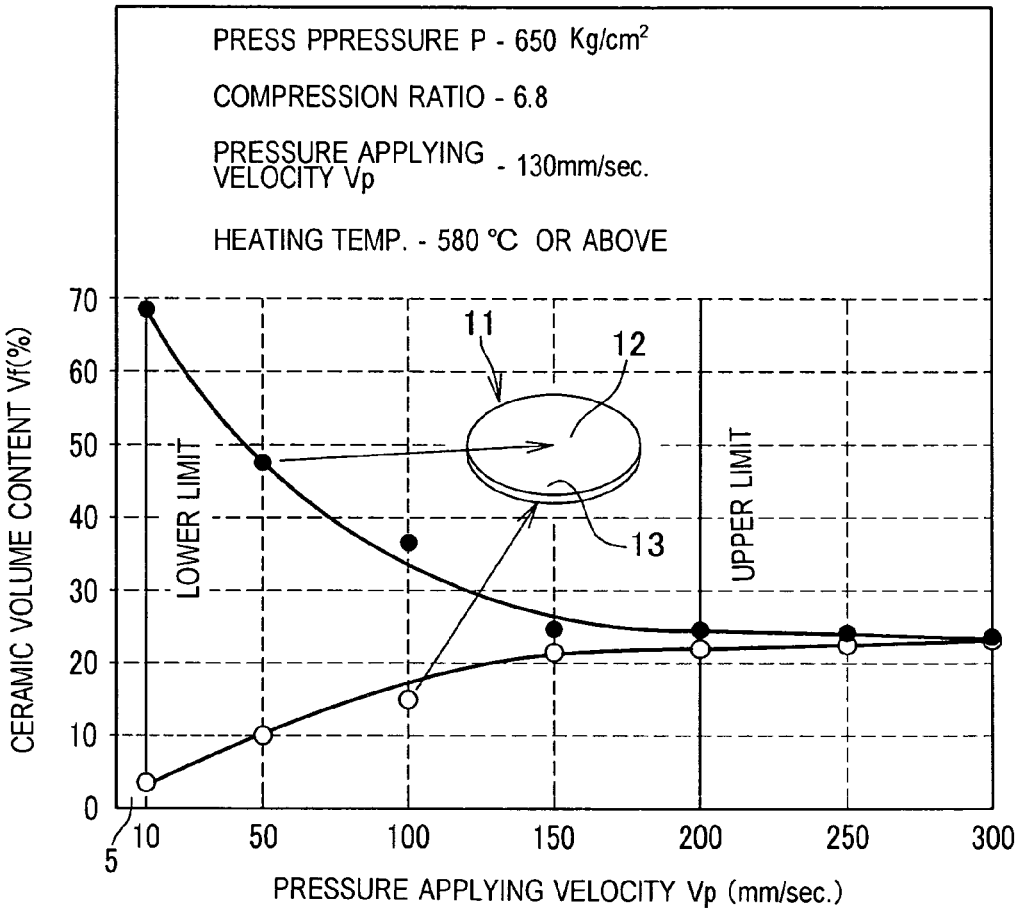
FIG. 4 is a graph showing the relation between the pressure applying velocity of the die assembly employed by the first forming method and the ceramic volume content of the first product.

FIG. 4 is a graph showing the relation between the pressure applying velocity employed by the first forming method and the ceramic volume content of the first product. The horizontal axis represents the pressure applying velocity Vp and the vertical axis represents the ceramic volume content Vf. The forming conditions are a pressure P of 650 kg/cm$^2$ as expressed by the surface pressure against the projected area of the billet, a compression ratio Rh of 6.8, a heating temperature of 580° C. or above and a die temperature of 300° C.

● indicates the ceramic volume content Vf of the middle portion 12 of the first product 11.

○ indicates the ceramic volume content Vf of the edge portion 13 of the first product 11.

The ceramic volume content Vf of the middle portion 12 decreases substantially in inverse proportion to an increase in pressure applying velocity Vp and then ceases to change from that of the billet.

The ceramic volume content Vf of the edge portion 13 increases substantially in proportion to an increase in pressure applying velocity Vp and then ceases to change from that of the billet.

This appears to teach that if the pressure applying velocity Vp is high, the speed at which the aluminum alloy flows laterally is so high that the alumina aggregate 21 cannot stay, but moves laterally with the flow of the aluminum alloy.

Thus, the control of the pressure applying velocity Vp makes it possible to control the ceramic volume content Vf.

In the forming method of present invention, the pressure applying velocity Vp is set in the range of 5 to 300 mm/sec.

If the pressure applying velocity Vp is below 5 mm/sec., hardly any increase can be achieved in the volume content of the reinforcing material, such as ceramics or carbon fiber, mixed in the matrix in the middle portion 12 (ceramic volume content Vf).

If the pressure applying velocity Vp exceeds 300 mm/sec., there is no change in the volume content (ceramic volume content Vf) of the middle or edge portion 12 or 13.

Thus, the control of the pressure applying velocity Vp or the compression ratio Rh makes a gradual decrease (gradient) in ceramic volume content Vf from the middle portion 12 of the first product 11 to its edge portion 13, while enabling the first product 11 to be formed in a desired shape.

Steps of preparing a composite material and forming a billet which differ from those described with reference to FIGS. 2A to 2D will now be described with reference to FIGS. 5A to 5D.

Figure 5A:
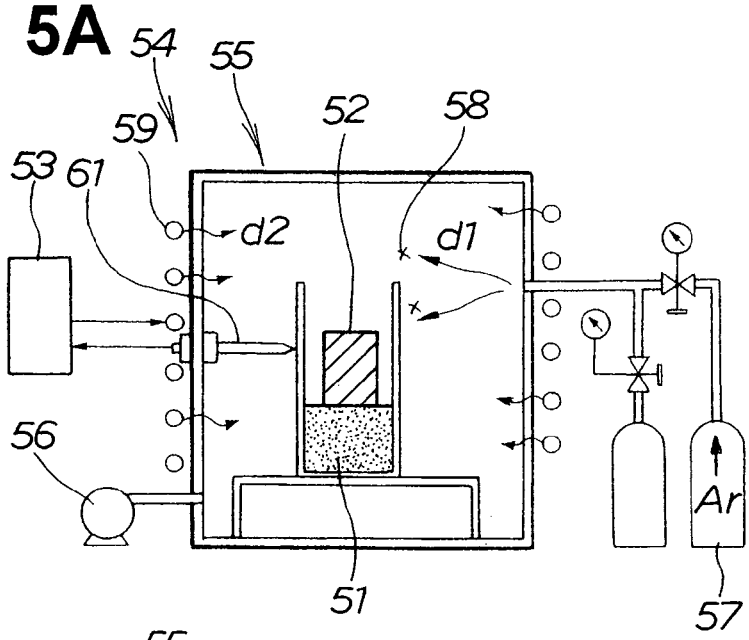
FIGS. 5A to 5D are diagrams showing the steps of manufacturing a metal-based composite material and forming a billet which differ from those in the first forming method.

A powder mixture 51 of an aggregated alumina powder and magnesium (Mg) and an aluminum alloy 52 are first placed in an atmosphere furnace 55 in an apparatus 54 for preparing an aluminum-based composite material, as shown in FIG. 5A. Reference numeral 53 denotes a control unit.

Then, the atmosphere furnace 55 is evacuated by a vacuum pump 56, so that oxygen may be removed from the atmosphere furnace 55. The vacuum pump 56 is stopped upon arrival of a certain vacuum degree and argon gas (Ar) 58 is supplied from its bottle 57 to the atmosphere furnace 55 as shown by arrows d1. Then, the heating of the powder mixture 51 and the aluminum alloy 52 by a heating coil 59 is started as shown by arrows d2.

The temperature of the atmosphere furnace 55 is raised (automatically), while it is detected by a temperature sensor 61. When a certain temperature (for example, about 750° C. to about 900° C.) is reached, the aluminum alloy 52 is melted. In the meantime, the magnesium (Mg) in the powder mixture 51 undergoes volatilization. There is no oxidation of the aluminum alloy 52 or magnesium (Mg), since an atmosphere of argon gas (Ar) 58 prevails in the atmosphere furnace 55.

Figure 5B:
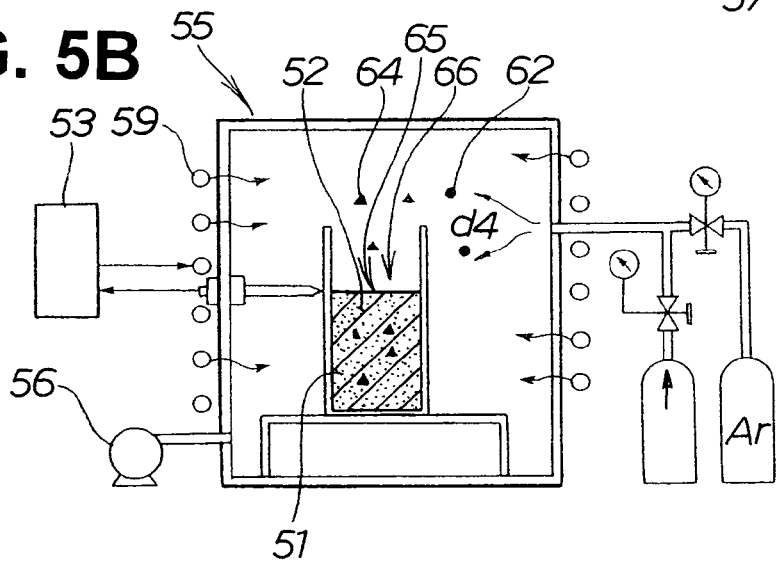

Then, the pressure of the atmosphere furnace 55 is raised by nitrogen gas ($N_2$) 62, the aggregated alumina powder in the powder mixture 51 is reduced by the action of magnesium nitride 64 and the molten aluminum alloy 52 is allowed to penetrate through the powder mixture 51 to give a metal-based composite material 65 and thereby an aluminum-based composite billet 66, as shown in FIG. 5B.

More specifically, nitrogen gas 62 is supplied into the atmosphere furnace 55 as shown by arrows d4, while argon gas 58 is removed therefrom by the vacuum pump 56. On that occasion, an elevated pressure (for example, atmospheric pressure+about 0.5 kg/cm$^2$) is applied. The atmosphere furnace 55 is purged with nitrogen gas 62.

When the atmosphere furnace 55 has been filled with an atmosphere of nitrogen gas 62, nitrogen gas 62 forms magnesium nitride ($Mg_3N_2$) 64 by reacting with magnesium (Mg). As magnesium nitride 64 reduces alumina, alumina is improved in wettability. As a result, the molten aluminum alloy 52 penetrates through among the aggregated alumina particles. The solidification of the aluminum alloy 52 completes an aluminum-based composite billet 66.

Figure 5C:
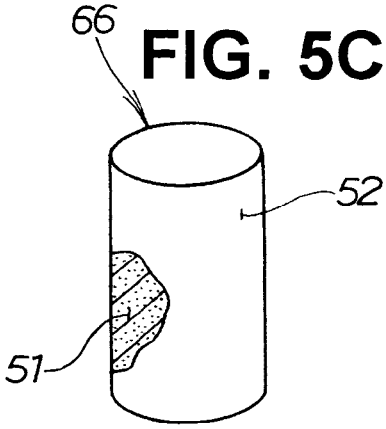

The aluminum-based composite billet 66 shown in FIG. 5C (hereinafter referred to merely as "billet 66") is a product obtained by the penetration of the aluminum alloy 52 through the powder mixture 51.

Figure 5D:
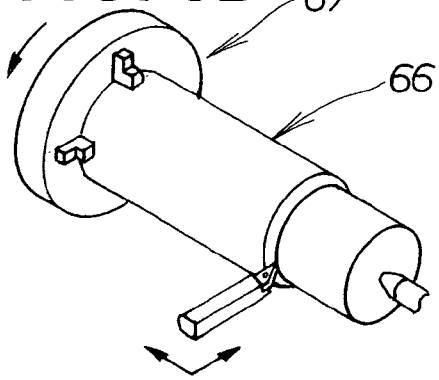

The billet 66 is cut into a specific outside diameter by an NC (numerically controlled) lathe 67, if required, as shown in FIG. 5D.

The steps of preparing a composite material and forming a billet which are shown in FIGS. 2A to 2D and FIGS. 5A to 5D are merely illustrative, and do not preclude any other method of preparing a composite material according to present invention.

Figure 6:
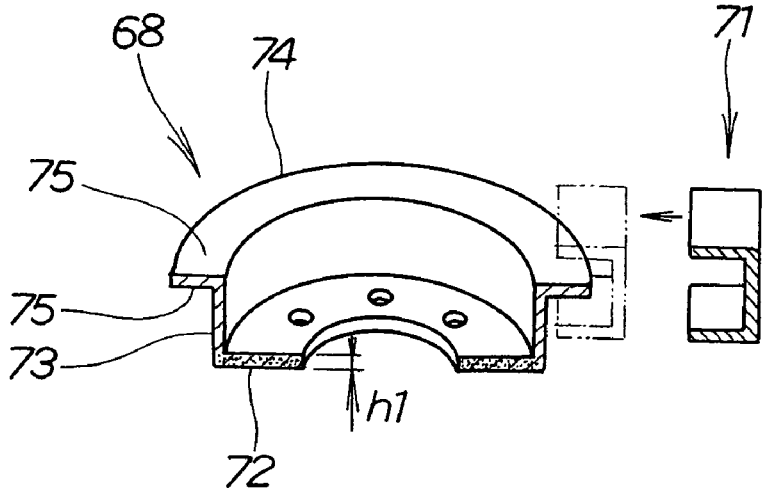
FIG. 6 is a diagram showing a second and a third product of a metal-based composite material formed by a second and a third forming method.

FIG. 6 shows a second and a third product of a metal-based composite material formed by a second and a third forming method, respectively, as will be described below. The second product 68 is a brake disk for a disk brake. The third product 71 is a member having a U-shaped cross section, such as a caliper for a disk brake, and is detailed in FIG. 10A.

The second product 68 comprising a brake disk comprises a fastening portion 72 formed in its center, a cylindrical connecting portion 73 formed contiguously to the fastening portion 72 and a flange-like sliding portion 74 formed contiguously to the upper end of the connecting portion 73 and projecting radially outwardly.

The fastening portion 72 is a portion which will be secured to a drive shaft in a vehicle by a plurality of bolts. The fastening portion 72 has a ceramic volume content Vm2 of about 40%.

The sliding portion 74 has an upper and a lower sliding surface 75, 75 against which a pad (not shown) will be pressed to produce friction. This friction restricts the rotation of the brake disk.

The second method of forming the second product 68 of the metal-based composite material will now be described with reference to FIGS. 7 and 8A to 8C. The third method of forming the third product 71 will be described later. The steps of preparing a composite material and heating a billet in the second forming method are identical to those in the first method and will not be described any more.

Figure 7:
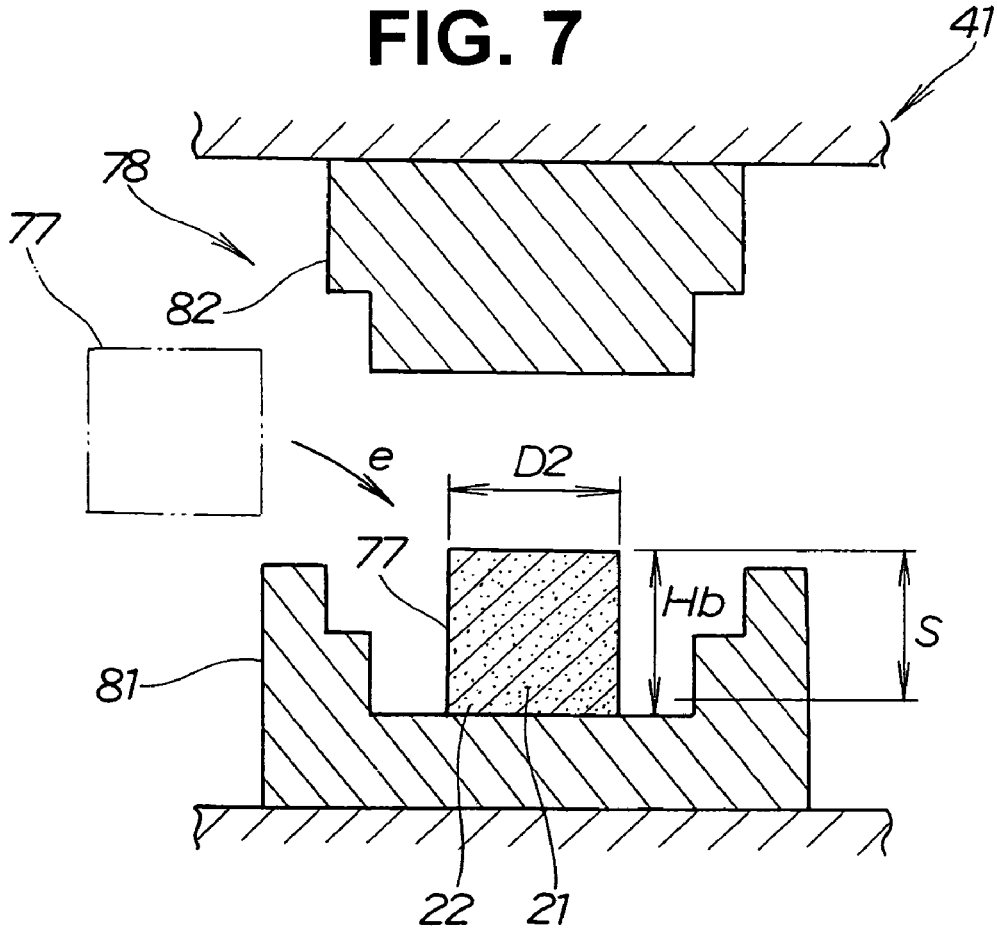
FIG. 7 is a diagram showing setting a heated billet in a die assembly in the second forming method according to present invention.

Referring to FIG. 7, the step of forming a billet in the second forming method employs a metal-based composite material 27 (see FIG. 2C) or an aluminum-based composite billet 66 (see FIG. 5C) to form a second billet 77 in the shape of a circular column. Hb denotes the height of the second billet 77 prior to pressure forming and D2 denotes its diameter.

The second billet 77 having a temperature of 580° C. or above is set in a die assembly 78 as shown by an arrow e to prepare for pressure application. Then, pressure is applied to form the second billet 77 into a specific shape by a press 41 having the die assembly 78 mounted therein.

The die assembly 78 is a closed one having a lower die 81, an upper punch 82 and a temperature control device not shown. The shape and construction of the die assembly 78 are merely illustrative.

The temperature control device may be of any type and may, for example, be so constructed as to rely on a fluid or electricity for temperature control. A temperature of 300° C. is, for example, set. It is also possible to use the die assembly at normal temperature.

The principal forming conditions set in an operating panel for the press 41 are, for example, a pressure P of about 650 kg/cm$^2$, a pressure applying velocity Vp of about 130 mm/sec. and a descending stroke S of 47 mm. Thus, the die assembly 78 is used to apply pressure to the second billet 77 at or above 580° C. with the pressure P, the pressure applying velocity Vp and the specific descending stroke S to form the second product.

Figure 8A:
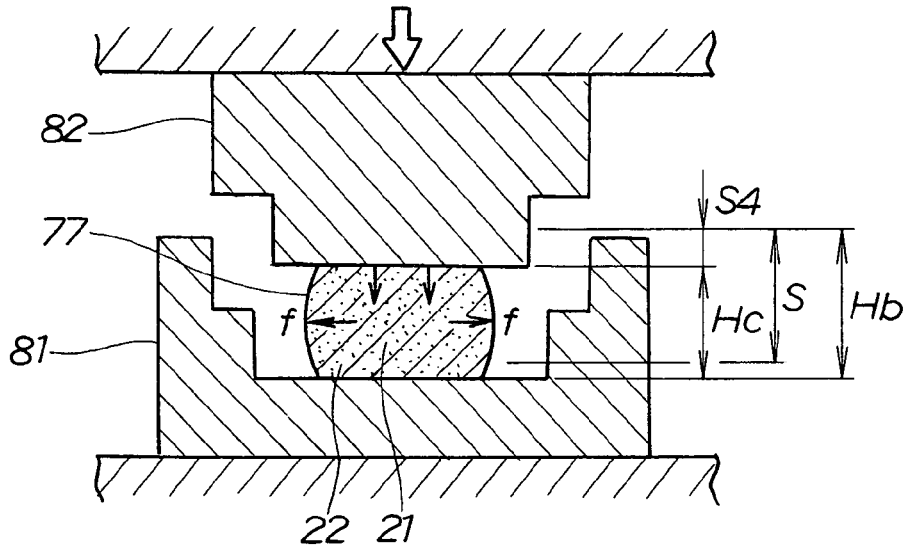
FIG. 8A to 8C diagrammatically illustrate the pressure forming step in the second forming method.
Figure 8B:
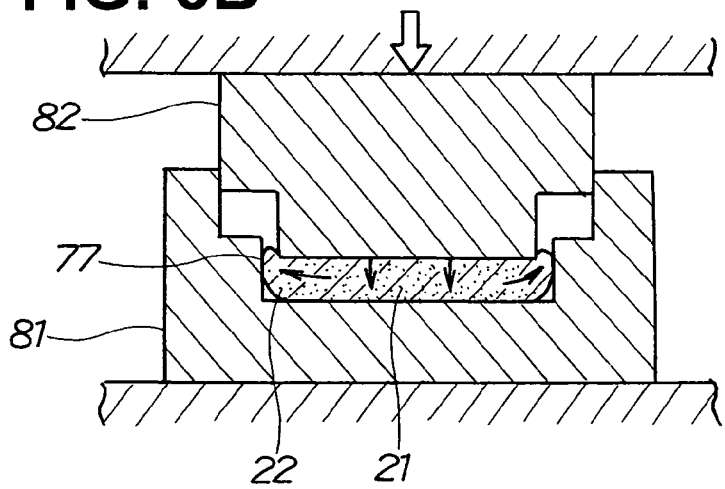
Figure 8C:
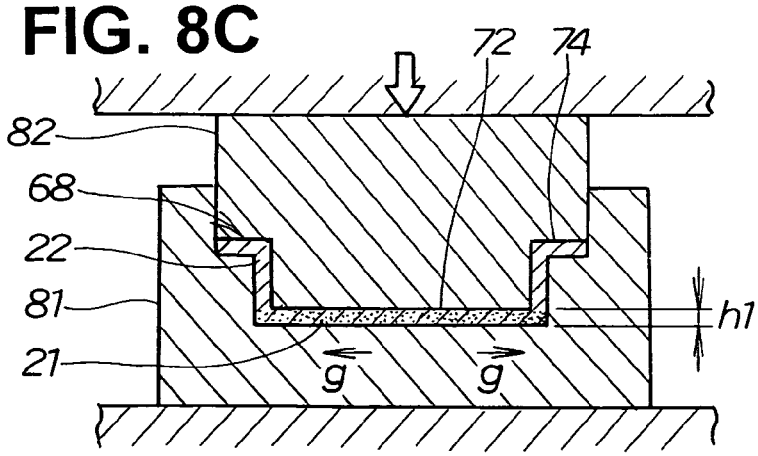

FIGS. 8A to 8C show the pressure application in the second forming method.

The upper punch 82 is lowered to cover a descending stroke S4, as shown in FIG. 8A. The height of the second billet 77 changes from Hb to Hc. During the process in which the height of the second billet 77 changes to Hc, the aluminum alloy 22 as the matrix having a temperature of 580° C. or above begins to collapse under pressure and also begins to flow laterally outwardly (to the right and left in the drawing and to the front and rear in the drawing) as shown by arrows f. On the other hand, the particles of the aggregate 21 maintain their dispersion and stay as they are, hardly moving laterally.

As the upper punch 82 continues to descend, the aluminum alloy 22 further flows outwardly through among the particles of the aggregate 21, as shown in FIG. 8B. The aggregate 21 begins to be destroyed by the contact and impingement of the particles thereof and begins to turn into a smaller aggregate or alumina ($Al_2O_3$) particles.

The upper punch 82 further continues to descend, and when it has covered the descending stroke to its lower limit, a second product 68 is formed, as shown in FIG. 8C. h1 is the height of the billet as pressed and corresponds to the thickness of a sheet.

During the process covering the descending stroke to its lower limit, the aluminum alloy 22 continues to flow outwardly. The particles of the aggregate 21 collapse under pressure and turn into a smaller aggregate or alumina ($Al_2O_3$) particles and nearly all of those particles stay in the fastening portion 72 defined by the middle portion of the second product 68, while the remainder are pushed by the aluminum alloy 22 to flow laterally outwardly (in the directions of arrows g) as the aluminum alloy 22 flows outwardly. As a result, the fastening portion 72 defined by the middle portion of the second product 68 has its ceramic volume content Vf raised to Vm2 (about 40%) and the sliding portion 74 defined by the edge portion of the second product 68 has its ceramic volume content Vf lowered to Ve2 (about 18%).

When the compression ratio of the second product 68 is expressed as Rh, the compression ratio Rh of the fastening portion 72 is expressed as Rh=Hb/h1, for example, 6.8. The compression ratio Rh of the sliding portion 74 is not set. According to the second forming method, therefore, the compression ratio Rh of the second product 68 differs from its fastening portion 72 to its sliding portion 74.

Figure 9:
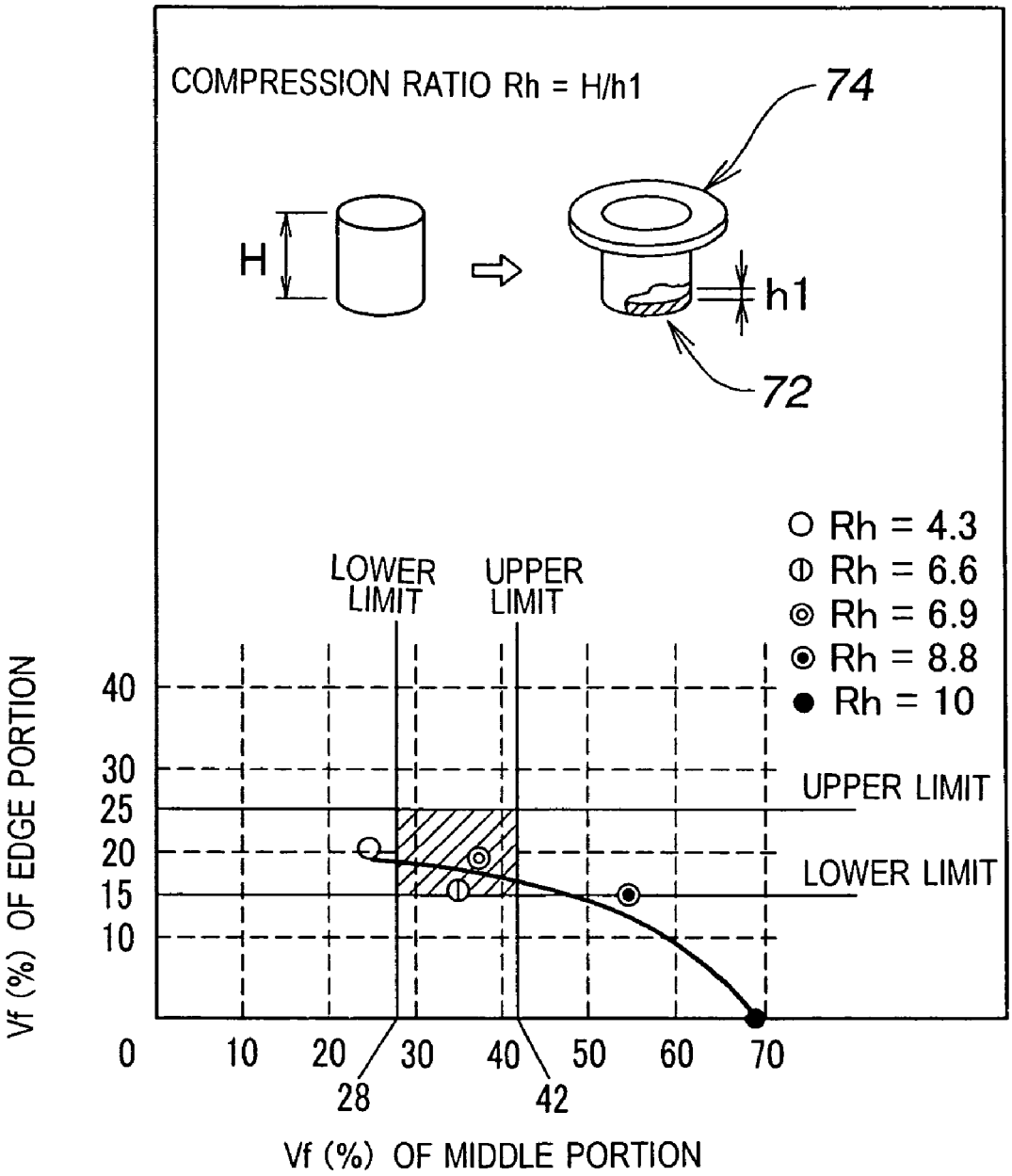
FIG. 9 is a graph showing the relation between the ceramic volume content of the middle portion of the product formed by the second forming method and the ceramic volume content of its edge portion.

FIG. 9 is a graph showing the relation between the ceramic volume content of the middle portion of the product formed by the second forming method and the ceramic volume content of its edge portion. The horizontal axis represents the ceramic volume content Vf of the middle portion. The vertical axis represents the ceramic volume content Vf of the edge portion. The forming conditions are a pressure P of 650 $kg/cm^2$ as expressed by the surface pressure against the projected area of the billet, a pressure applying velocity of about 130 mm/sec., a heating temperature of 580° C. or above and a die temperature of 300° C.

The graph in FIG. 9 also shows the relation between the ceramic volume content of the middle portion 12 of the first product 11 as described with reference to FIG. 1A and the ceramic volume content of its edge portion 13.

The ceramic volume content Vf of the edge portion (sliding portion) 74 decreases substantially in proportion to an increase in the ceramic volume content Vf of the middle portion (fastening portion) 72.

The second product 68 (see FIG. 6) is a brake disk. The ceramic volume content Vf of the fastening portion 72 (see FIG. 6) of the brake disk is set in the range of 28 to 42%.

According to the second forming method, therefore, the ceramic volume content Vf of the middle portion (fastening portion) 72 is set in the range of 28 to 42%.

If the ceramic volume content Vf of the middle portion (fastening portion) 72 is less than 28%, it is likely that a given bolt tightening torque may cause the buckling of the fastening portion 72 when the middle portion (fastening portion) 72 is attached by bolts.

If the ceramic volume content Vf of the middle portion (fastening portion) 72 exceeds 42%, the ceramics brings about a lowering in workability and a higher production cost.

The ceramic volume content Vf of the edge portion (sliding portion) 74 of the brake disk is set in the range of 15 to 25%.

If the ceramic volume content Vf of the edge portion (sliding portion) 74 is less than 15%, a lowering in hardness and wear resistance occur.

If the ceramic volume content Vf of the edge portion (sliding portion) 74 exceeds 25%, the ceramics brings about a lowering in workability by calling for a great deal of time and labor in a job for achieving high accuracy, such as grinding or polishing.

The graph in FIG. 3 may also be regarded as showing the relation between the compression ratio by the second forming method and the ceramic volume content of the second product. The graph in FIG. 4 may also be regarded as showing the relation between the pressure applying velocity employed by the second forming method and the ceramic volume content of the second product.

Figure 10A:
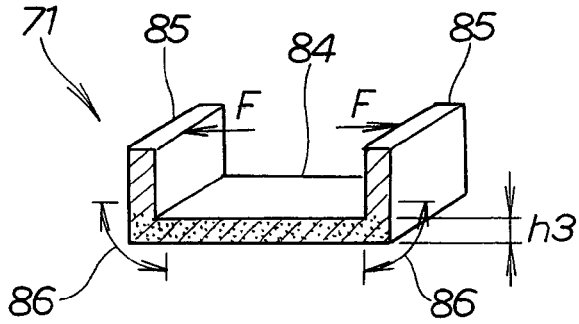
FIGS. 10A to 10C are diagrams showing the third forming method according to present invention.
Figure 10B:
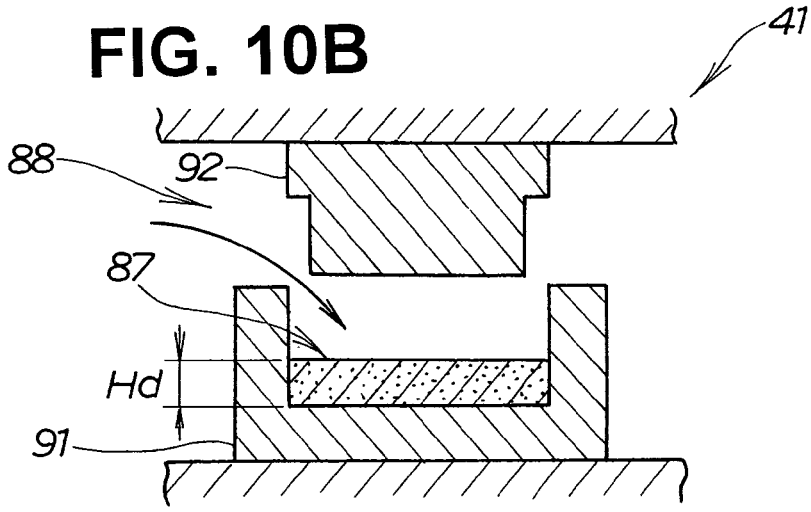
Figure 10C:
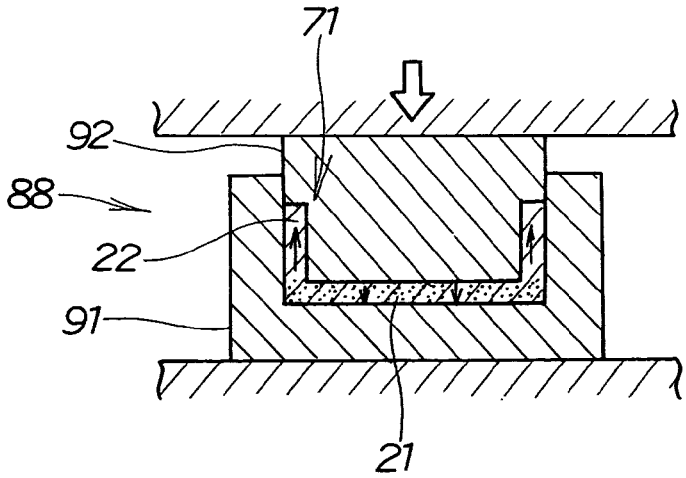

The third forming method according to present invention will now be described with reference to FIGS. 10A to 10C. FIG. 10A shows a third product and FIGS. 10B and 10C show the step of pressure application.

Referring to FIG. 10A, the third product 71 is a member having a U-shaped cross section and comprises a first sheet portion 84 formed in its center and two second sheet portions 85, 85 extending from two opposite edges of the first sheet portion 84 at right angles thereto. The second sheet portions 85, 85 are each subjected to force F. Reference numeral 86, 86 denotes each corner, and h3 denotes the height of the billet as pressure formed and corresponds to the sheet thickness.

The third product 71 has a ceramic volume content Vf which is higher at the corners 86, 86 than at the free ends of the second sheet portions 85, 85 and is thereby intended for an improvement in strength of the U-shaped member and a reduction of its weight.

The third method of forming the third product 71 of the metal-based composite material will now be described. The steps of preparing a composite material and heating a billet are identical to those in the first method and will not be described any more.

The step of forming a billet in the third forming method employs a metal-based composite material 27 (see FIG. 2C) or an aluminum-based composite billet 66 (see FIG. 5C) to form a third billet 87, as shown in FIG. 10B. The third billet 87 is a sheet formed with a given width and length, and a billet height Hd prior to pressure forming.

In the pressure forming step, the third billet 87 having a temperature of 580° C. or above is set in a die assembly 88 as shown by an arrow and is formed into a specific shape by the operation of a press 41 having the die assembly 88 mounted therein. The die assembly 88 has a lower die 91, an upper punch 92 and a temperature control device not shown.

The principal forming conditions set in an operating panel for the press 41 are a pressure P, a pressure applying velocity Vp and a descending stroke S. Thus, the die assembly 88 is used to apply pressure to the third billet 87 at or above 580° C. with the pressure P, the pressure applying velocity Vp and the specific descending stroke S to form the third product.

The upper punch 92 is moved to the lower limit of its stroke to complete the third product 71, as shown in FIG. 10C.

During the process in which pressure is applied to the third billet 87, the aluminum alloy 22 begins to break down under pressure and flows laterally (to the right and left in the drawing) outwardly through among the particles of the aggregate 21, as already stated.

On the other hand, the aggregate 21 is destroyed by the contact and impingement of the particles thereof and breaks down under pressure into a smaller aggregate or alumina ($Al_2O_3$) particles, and nearly all of them stay in the first sheet portion 84 and the corners 86, 86. As a result, the first sheet portion 84 of the third product 71 shown in FIG. 10A has a ceramic volume content Vf or Vm3 (about 40%) and the corners 86, 86 have a ceramic volume content Vf of about 37%. The higher ceramic volume content Vf of the corners 86, 86 on which a large force bears raises gives a high Young's modulus to the material of the corners 86, 86 and realizes an improvement in the strength of the U-shaped member and a reduction of its weight.

The second sheet portions 85, 85 as edge portions of the third product 71 have a ceramic volume content Vf or Ve3 (about 18%).

The first sheet portion 84 of the third product 71 has a compression ratio Rh expressed as Rh=Hd/h3. No compression ratio Rh is set for the second sheet portions 85, 85 but the necessary sheet thickness is set therefor. According to the third forming method, therefore, the third product 71 has a compression ratio Rh differing from its first sheet portion 84 to its second sheet portions 85, 85.

Figure 11:
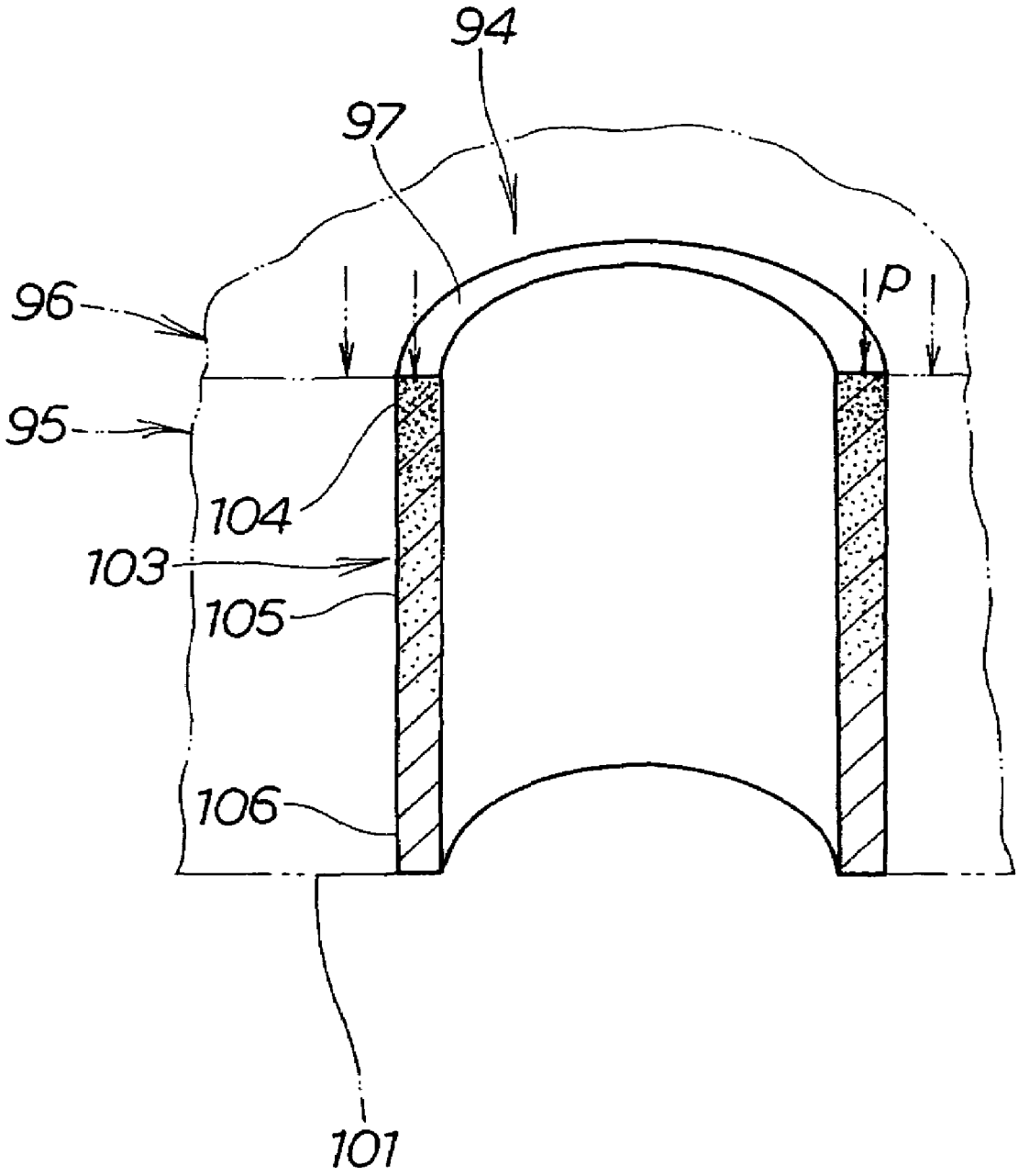
FIG. 11 is a diagram showing a fourth product of a metal-based composite material formed by a fourth forming method according to the present invention.

FIG. 11 shows a fourth product 94 of a metal-based composite material formed by a fourth forming method according to present invention which will be described later.

The fourth product 94 is a cylindrical member cast in a casing 95, such as a cylinder block, and having a sheet surface 97 making intimate contact with a flange 96, such as a cylinder head.

The fourth product 94 has a ceramic volume content Vf expressed as Vm4 between one end 104 of its peripheral wall 103 facing the flange 96 and its middle portion 105. The ceramic volume content Vm4 is higher than the ceramic volume content Vb of the billet (about 23 to 24%) and the ceramic volume content Ve4 between the other end 106 adjoining the inside 101 of the casing 95 and the middle portion 105 is lower than the ceramic volume content Vb of the billet. Thus, the sheet surface 97 is formed at one end 104 having its ceramic volume content Vf elevated to Vm4.

Owing to its ceramic volume content elevated to Vm4, the sheet surface 97 is strong enough to withstand any bolt tightening force (axial force) applied to attach the flange 96 and is not deformed even by the flange 96 contacting it intimately with a surface pressure p arising from the bolt tightening torque, but can prevent the leakage of, for example, any hydraulic pressure (hydraulic fluid) or pneumatic pressure (air) and maintain high pressure.

The fourth method of forming the fourth product 94 described above will now be described with reference to FIGS. 12A to 12D. The steps of preparing a composite material and heating a billet are identical to those in the first method and will not be described any more.

Figure 12A:
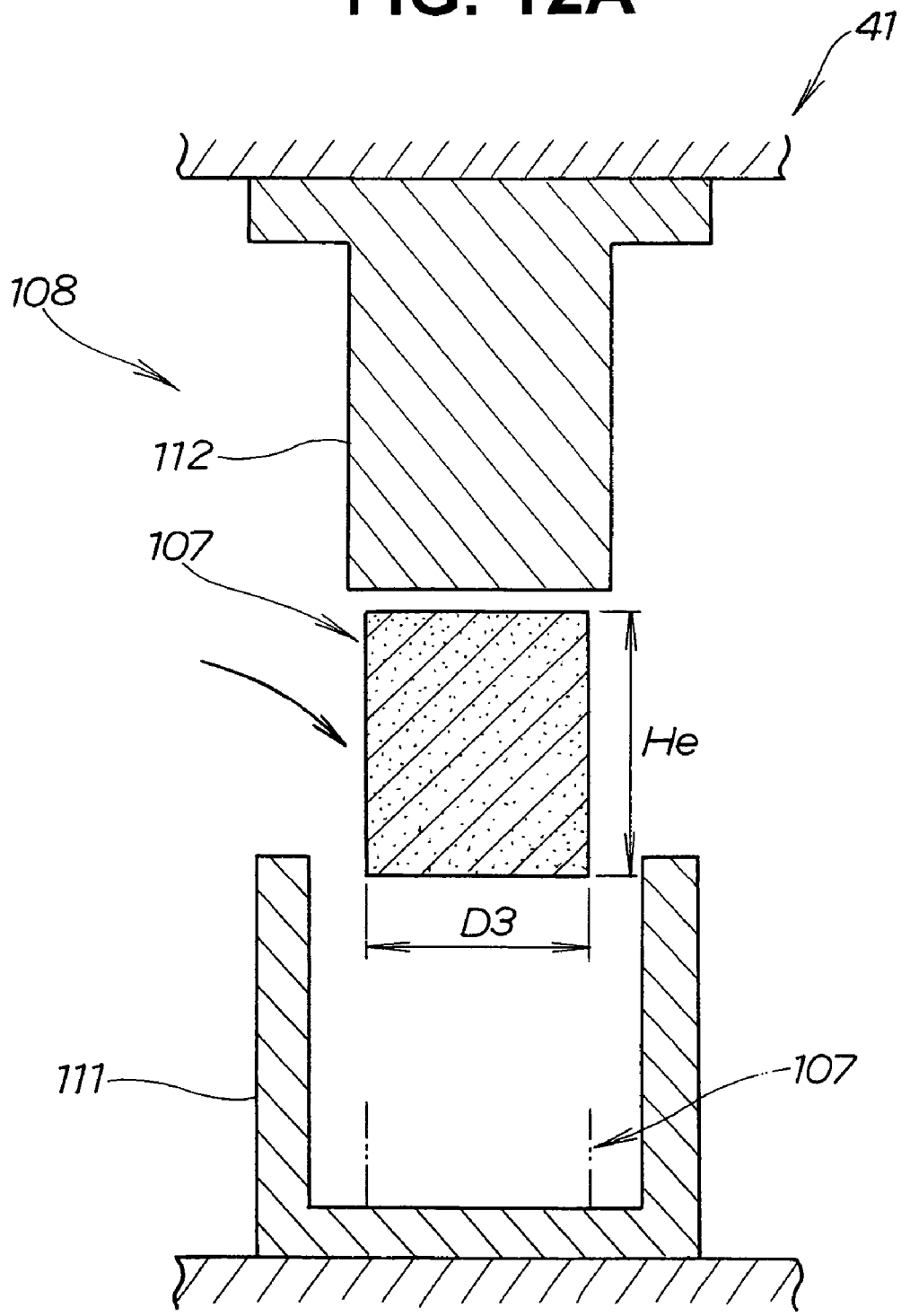
FIGS. 12A to 12D are diagrams showing the pressure forming step in the fourth forming method according to the present invention.

The step of forming a billet in the fourth forming method employs a metal-based composite material 27 (see FIG. 2C) or an aluminum-based composite billet 66 (see FIG. 5C) to form a fourth billet 107 in the shape of a circular column, as shown in FIG. 12A. D3 denotes its diameter and He denotes the height of the fourth billet 107 prior to pressure forming.

In the pressure forming step, the fourth billet 107 having a temperature of 580° C. or above is set in a die assembly 108 as shown by a two-dot chain line and is formed into a specific shape by the operation of a press 41 having the die assembly 108 mounted therein.

The die assembly 108 has a lower die 111, an upper punch 112 and a temperature control device not shown. The die assembly 108 is used to apply pressure to the fourth billet 107 at or above 580° C. with the pressure P, the pressure applying velocity Vp and the specific descending stroke to form the fourth product.

Figure 12B:
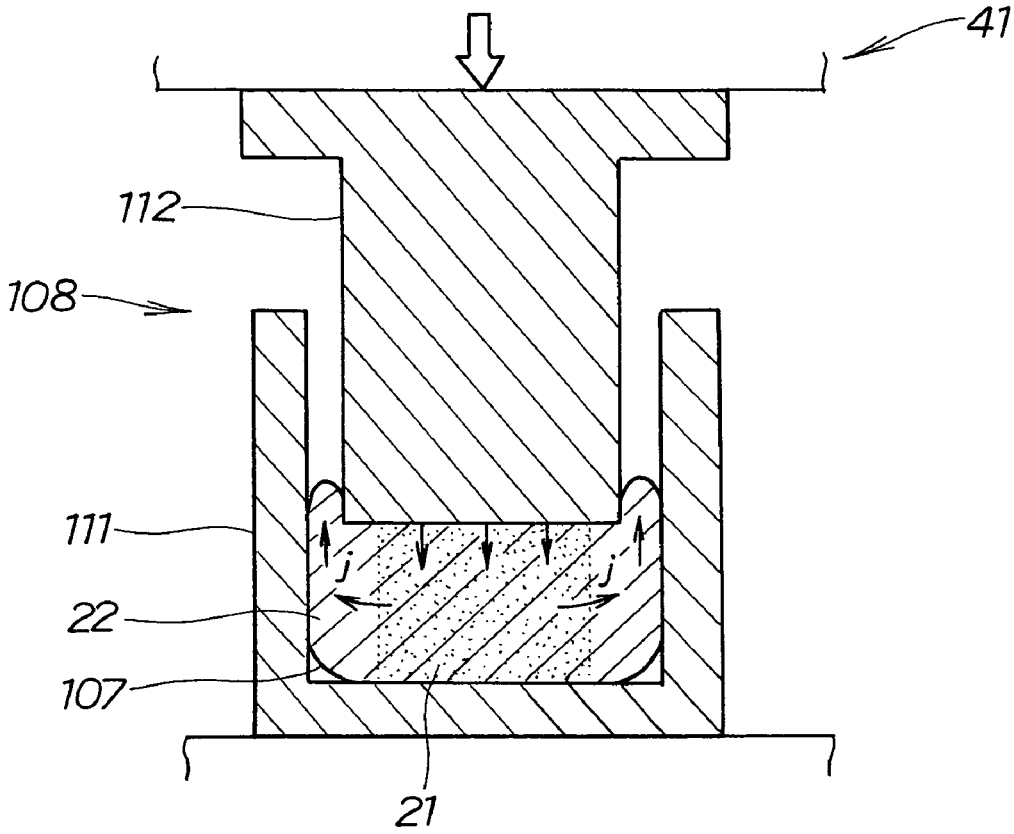

During the process in which pressure is applied to the fourth billet 107, the aluminum alloy 22 flows outwardly (in the directions of arrows j) through among the particles of the aggregate 21, as already stated, and as shown in FIG. 12B.

On the other hand, the aggregate 21 begins to be destroyed by the contact and impingement of the particles thereof and begins to break down into a smaller aggregate or alumina ($Al_2O_3$) particles.

Figure 12C:
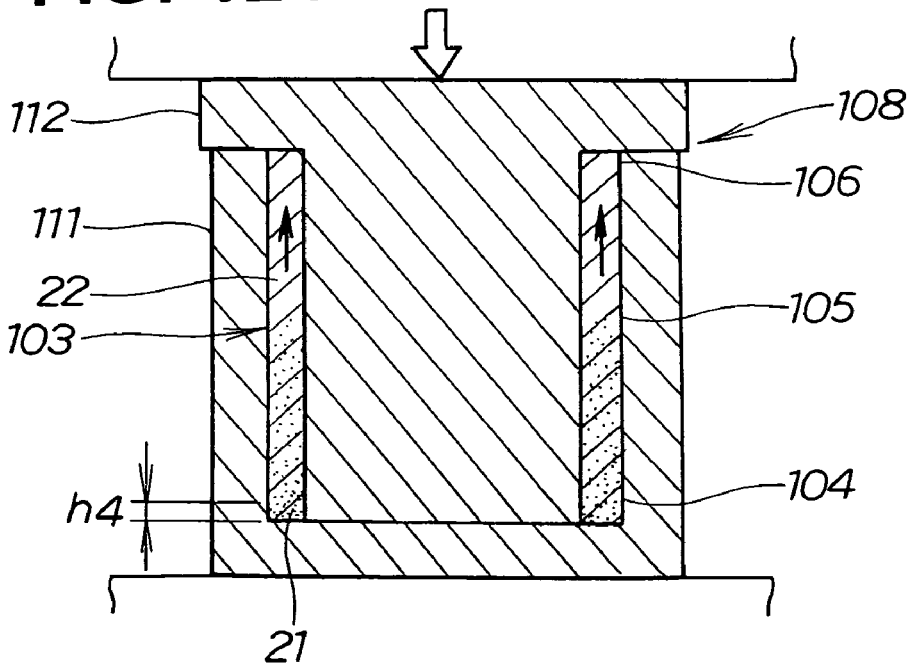

Then, the upper punch 112 is moved to the lower limit of its stroke through the billet as shown in FIG. 12C, whereby the fourth product 94 as shown in FIG. 11 is obtained.

During the process in which pressure continues to be applied to the fourth billet 107 (see FIG. 12B), the aggregate 21 breaks down under pressure into a smaller aggregate or alumina ($Al_2O_3$) particles and nearly all of the smaller aggregate or alumina particles stay in the middle portion, while the remainder are pushed by the aluminum alloy 22 to flow laterally outwardly (to the right and left in the drawing and to the front and rear in the drawing) as the aluminum alloy 22 flows outwardly. As a result, one end 104 of the fourth product 94 (see FIG. 11) defining its middle portion has its ceramic volume content Vf expressed as Vm4 (about 40%) and the other end 106 of the fourth product 94 (see FIG. 11) defining its edge portion has its ceramic volume content Vf expressed as Ve4 (about 18%).

h4 denotes the height of the billet after pressure forming, for example, 1 mm. When the upper punch 112 is passed through the billet, the billet has a height of 0 mm, but its ceramic volume content Vf hardly differs from the ceramic volume content Vf exhibited by one end 104 when the billet height is set at 1 mm, and the fourth product 94 (see FIG. 11) has a compression ratio Rh expressed as Rh=He/h4. No compression ratio Rh is set for its peripheral wall 103, but the necessary sheet thickness is set therefor.

According to the fourth forming method, therefore, the fourth product 94 has a compression ratio Rh differing from its bottom to its peripheral wall 103.

Figure 12D:
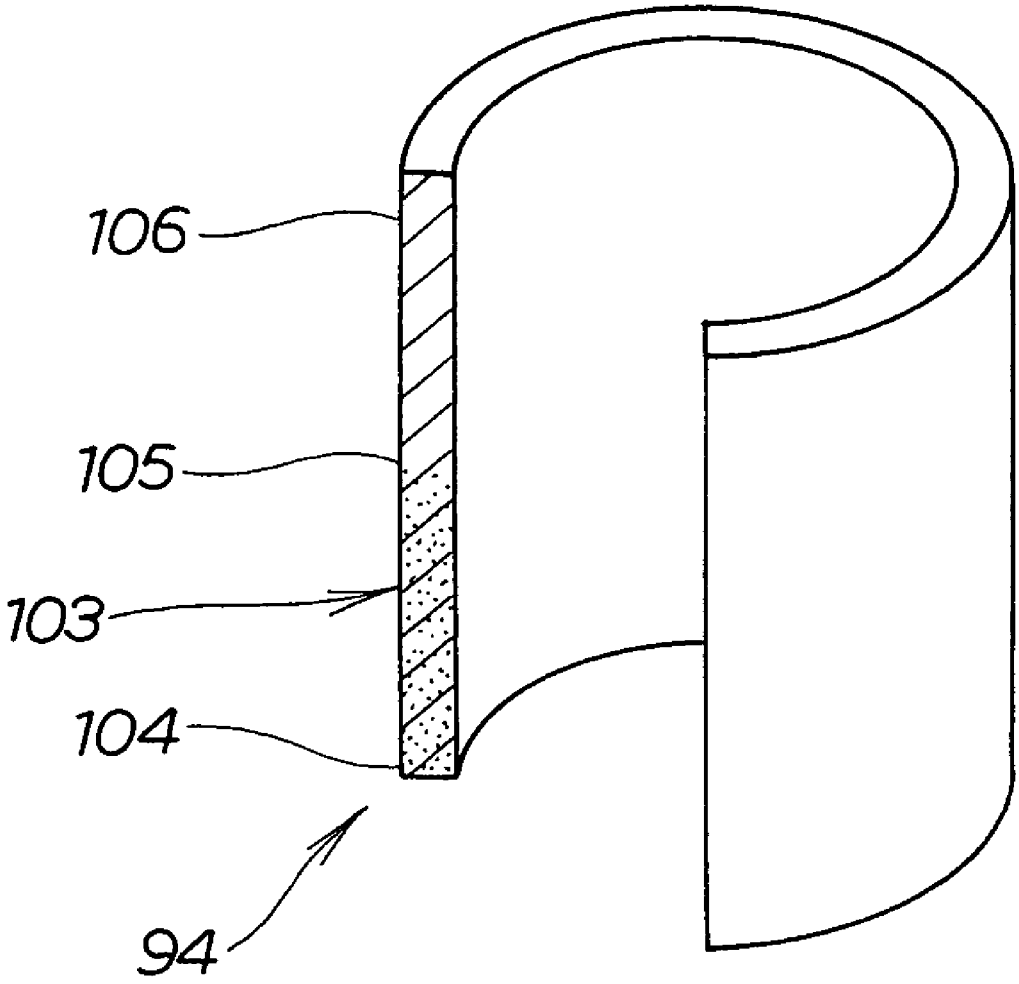

The die assembly 108 (see FIG. 12C) is opened and the fourth product 94 is taken out, as shown in FIG. 12D.

The subsequent step performs casting with the fourth product 94 set in a mold.

Thus, the forming method according to present invention sets the compression ratio Rh for the middle portion of any of the first to fourth products 11, 68, 71 and 94 to vary the compression ratio Rh of each product from one portion to another, so that each of the first to fourth products may have a ceramic volume content Vf differing from its middle portion to its edge portion, as stated in connection with each of the first to fourth forming methods. As the mere closure of the die assembly is sufficient to form a product having a ceramic volume content differing from one portion to another, it is easier to make a product of a metal-based composite material having a ceramic volume content differing from one portion to another.

Figure 13A:
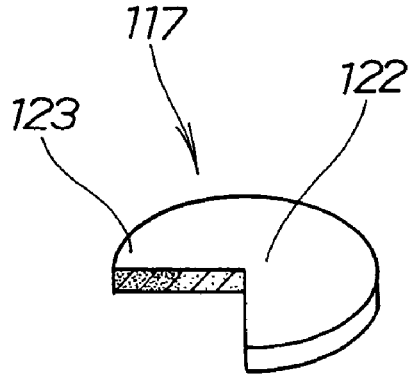
FIGS. 13A to 13C are diagrams showing a fifth, a sixth and a seventh pro-duct of a metal-based composite material formed by a fifth, a sixth and a seventh forming method according to the present invention.
Figure 13B:
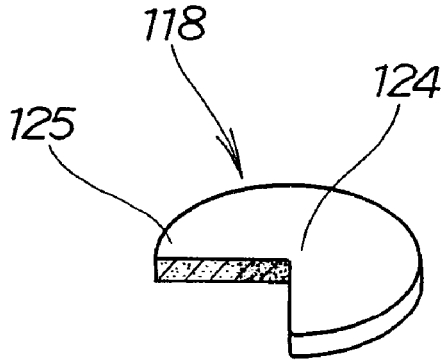
Figure 13C:
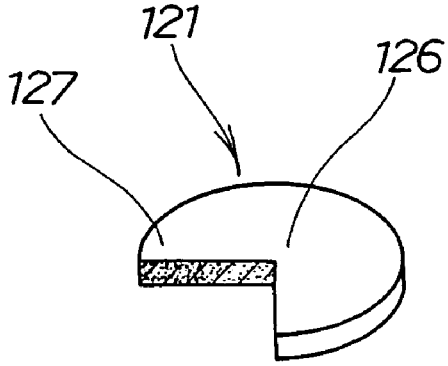

FIGS. 13A to 13C show a fifth, a sixth and a seventh product of a metal-based composite material formed by a fifth, a sixth and a seventh forming method according to present invention.

The fifth product 117 shown in FIG. 13A has a ceramic volume content Vf decreasing gradually in a way opposite to that of the first product 11 shown in FIG. 1A and its ceramic volume content Vf gradually increases from its middle portion 122 to its edge portion 123. More specifically, its middle portion 122 has a ceramic volume content Vm5 of about 18% and its edge portion 123 has a ceramic volume content Ve5 of about 40%. The fifth product 117 is a disk-like sheet member of which the edge portion 123 has a ceramic volume content Ve5 which is higher than the ceramic volume content Vm5 of its middle portion 122 (Ve5>Vm5).

When the ceramic volume contents of the middle and edge portions 122 and 123 are compared with the ceramic volume content Vb of the metal-based composite material 27 (see FIG. 2C), Vm5<Vb<Ve5.

When the Young's modulus of the middle portion 122 is Em5, while the Young's modulus of the edge portion 123 is Ee5 (Ee5>Em5), Em5<Eb<Ee5 when the Young's moduli of the middle and edge portions 122 and 123 are compared with the Young's modulus Eb of the metal-based composite material 27 (see FIG. 2C).

The sixth product 118 shown in FIG. 13B has a ceramic volume content Vf decreasing gradually from its middle portion 124 to its edge portion 125. More specifically, its middle portion 124 has a ceramic volume content Vm6 of about 28% and its edge portion 125 has a ceramic volume content Ve6 of about 20%. The sixth product 118 is a disk-like sheet member of which the edge portion 125 has a ceramic volume content Ve6 which is lower than the ceramic volume content Vm6 of its middle portion 124 (Ve6<Vm6).

The ceramic volume content Vm6 of the middle portion 124 is higher than the ceramic volume content Vb of the metal-based composite material 27 shown in FIG. 2C, and the ceramic volume content Ve6 of the edge portion 125 is substantially equal to it.

The seventh product 121 shown in FIG. 13C has a ceramic volume content Vf decreasing gradually in a way opposite to that of the sixth product 118 (see FIG. 13B) and its ceramic volume content Vf gradually increases from its middle portion 126 to its edge portion 127. More specifically, its middle portion 126 has a ceramic volume content Vm7 of about 20% and its edge portion 127 has a ceramic volume content Ve7 of about 28%. The seventh product 121 is a disk-like sheet member of which the edge portion 127 has a ceramic volume content Ve7 which is higher than the ceramic volume content Vm7 of its middle portion 126 (Ve7>Vm7).

The ceramic volume content Vm7 of the middle portion 126 is higher than the ceramic volume content Vb of the metal-based composite material 27 shown in FIG. 2C, and the ceramic volume content Ve7 of the edge portion 127 is substantially equal to it.

Description will now be made successively of a fifth, a sixth and a seventh method of forming a fifth, a sixth and a seventh product 117, 118 and 121, respectively, of a metal-based composite material.

The fifth method of forming the fifth product will first be described with reference to FIGS. 14A to 14C. The steps of preparing a composite material and heating a billet are identical to those in the first method and will not be described any more.

Figure 14A:
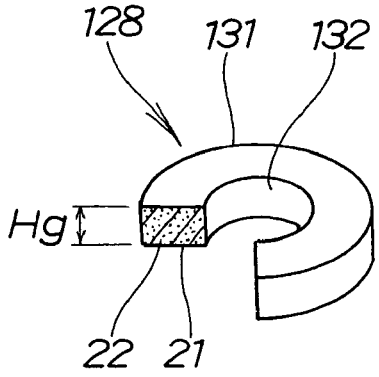
FIGS. 14A to 14C are diagrams showing a billet employed in the fifth forming method according to the present invention and the pressure forming step in the fifth forming method.

The step of forming a billet in the fifth forming method employs a metal-based composite material 27 (see FIG. 2C) or an aluminum-based composite billet 66 (see FIG. 5C) to form a fifth billet 128, as shown in FIG. 14A. The fifth billet 128 is an annular sheet body 131 having a hole 132 in its center and the height of the annular body 131 which is the height of the billet prior to pressure forming is Hg.

Figure 14B:
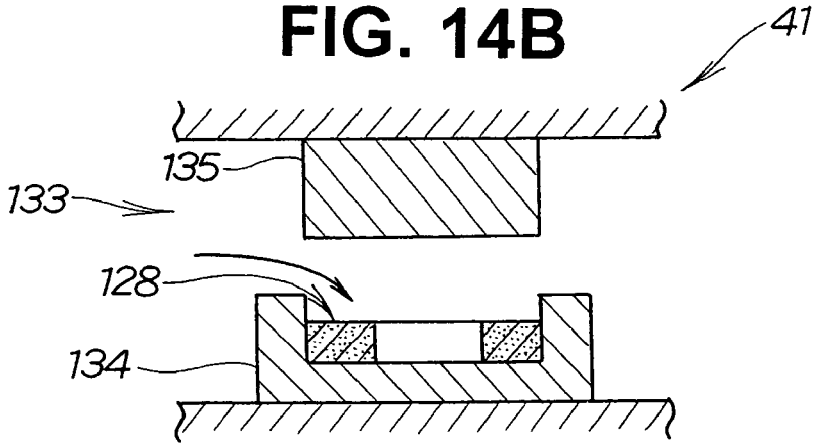

Referring to FIG. 14B, the fifth billet 128 having a temperature of 580° C. or above is set in a die assembly 133 as shown by an arrow and is formed into a specific shape by the operation of a press 41 having the die assembly 133 mounted therein.

The die assembly 133 has a lower die 134, an upper punch 135 and a temperature control device not shown. The die assembly 133 is used to apply pressure to the fifth billet 128 at or above 580° C. with the pressure P, the pressure applying velocity Vp and the specific descending stroke to form the fifth product 117 shown in FIG. 13A.

Figure 14C:
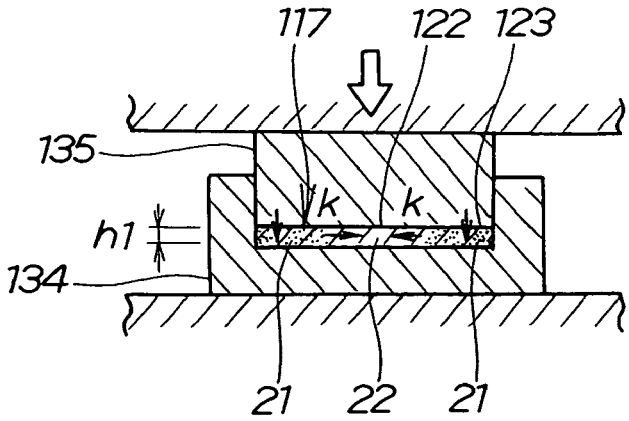

Then, the upper punch 135 is moved to the lower limit of its stroke as shown in FIG. 14C, whereby the fifth product 117 is obtained.

More specifically, during the process in which pressure is applied to the fifth billet 128, the aluminum alloy 22 begins to break down under pressure and flows laterally (to the right and left in the drawing and to the front and rear in the drawing) toward the center of the hole 132 through among the particles of the aggregate 21, as shown by arrows k.

On the other hand, the aggregate 21 is destroyed by the contact and impingement of the particles thereof and breaks down under pressure into a smaller aggregate or alumina ($Al_2O_3$) particles, and nearly all of them stay in the annular body 131 without moving inwardly toward the hole 132. As a result, the middle portion 122 of the fifth product 117 has a ceramic volume content Vf or Vm5 of about 18% and its edge portion 123 has a ceramic volume content Vf or Ve5 of about 40%.

h1 denotes the height of the billet after pressure forming and corresponds to the sheet thickness of the fifth product 117. The compression ratio Rh of the annular body 131 for the fifth product 117 is Rh=Hg/h1. No compression ratio Rh is set for the middle portion 122.

According to the fifth forming method, therefore, the fifth product 117 has a compression ratio Rh differing from the annular body 131 to the middle portion 122.

The sixth method of forming the sixth product shown in FIG. 13B will now be described with reference to FIGS. 15A to 15C. The steps of preparing a composite material and heating a billet are identical to those in the first method and will not be described any more.

Figure 15A:
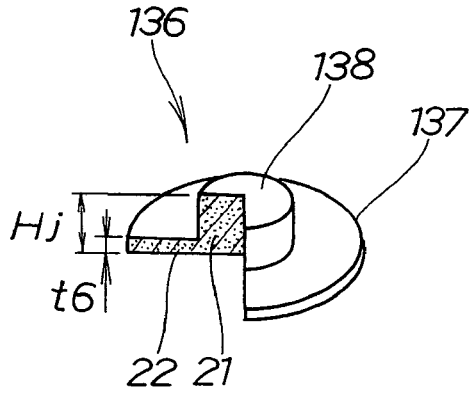
FIGS. 15A to 15C are diagrams showing a billet employed in the sixth forming method according to the present invention and the pressure forming step in the sixth forming method.

The step of forming a billet in the sixth forming method employs a metal-based composite material 27 (see FIG. 2C) or an aluminum-based composite billet 66 (see FIG. 5C) to form a sixth billet 136, as shown in FIG. 15A. The sixth billet 136 has a disk portion 137 and a circular column portion 138 formed integrally with the disk portion 137 and protruding from its center. The disk portion 137 has a thickness t6 and the circular column portion 138 has a height Hj which is the height of the billet prior to pressure forming. Thus, the sixth billet 136 has a height varied by the height Hj of its circular column portion 138 over the thickness t6 of its disk portion 137.

Figure 15B:
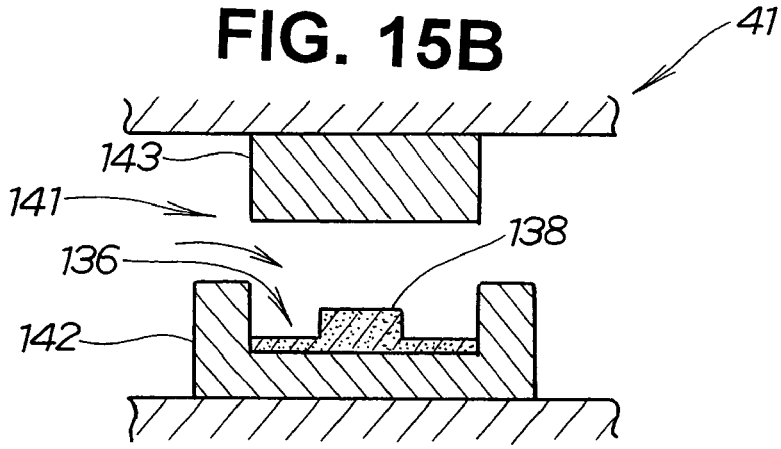

Referring to FIG. 15B, the sixth billet 136 having a temperature of 580° C. or above is set in a die assembly 141 as shown by an arrow and is formed into a specific shape by the operation of a press 41 having the die assembly 141 mounted therein.

The die assembly 141 has a lower die 142, an upper punch 143 and a temperature control device not shown. The die assembly 141 is used to apply pressure to the sixth billet 136 at or above 580° C. with the pressure P, the pressure applying velocity Vp and the specific descending stroke to form the sixth product 118 (see FIG. 13B).

Figure 15C:
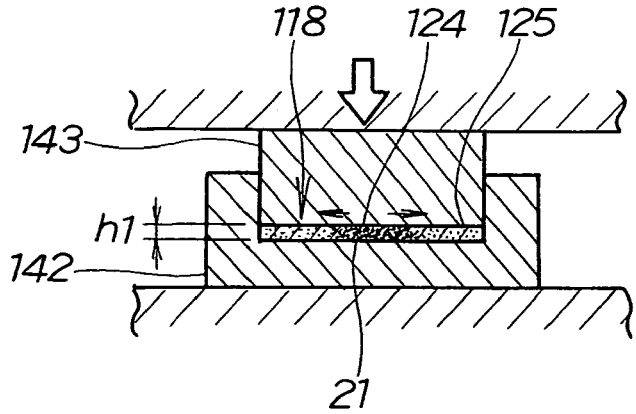

Then, the upper punch 143 is moved to the lower limit of its stroke as shown in FIG. 15C, whereby the sixth product 118 is obtained.

More specifically, during the process in which pressure is applied to the sixth billet 136, its circular column portion 138 begins to break down and the aluminum alloy 22 in its circular column portion 138 flows under pressure outwardly (in the directions of arrows) through among the particles of the aggregate 21.

On the other hand, the aggregate 21 in the circular column portion 138 is destroyed by the contact and impingement of the particles thereof and breaks down under pressure into a smaller aggregate or alumina ($Al_2O_3$) particles, and nearly all of them stay in the circular column portion 138. As a result, the middle portion 124 of the sixth product 118 has a ceramic volume content Vf or Vm6 of about 28%. Its edge portion 125 has a ceramic volume content Vf or Ve6 of about 20%.

h1 denotes the height of the billet after pressure forming and corresponds to the sheet thickness of the sixth product 118. The compression ratio Rh of the middle portion 124 of the sixth product 118 is Rh=Hj/h1. The compression ratio Rh of its edge portion 125 is Rh=t6/h1, or about 1.

According to the sixth forming method, therefore, the sixth product 118 has a compression ratio Rh differing from its middle portion 124 to its edge portion 125.

The seventh method of forming the seventh product shown in FIG. 13C will now be described with reference to FIGS. 16A to 16C. The steps of preparing a composite material and heating a billet are identical to those in the first method and will not be described any more.

Figure 16A:
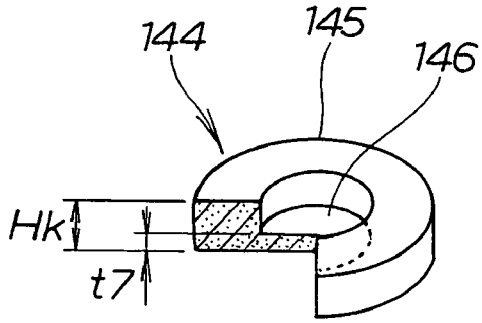
FIGS. 16A to 16C are diagrams showing a billet employed in the seventh forming method according to the present invention and the pressure forming step in the seventh forming method.

The step of forming a billet in the seventh forming method employs a metal-based composite material 27 (see FIG. 2C) or an aluminum-based composite billet 66 (see FIG. 5C) to form a seventh billet 144, as shown in FIG. 16A. The sixth billet 144 is a disk 145 having a circular concavity 146 in its center and the disk 145 has a thickness t7 at the bottom of its concavity 146 and a height Hk which is the height of the billet prior to pressure forming. Thus, the seventh billet 144 has a height varied by the height Hk of the disk 145 over its thickness t7 at the bottom of its concavity 146.

Figure 16B:
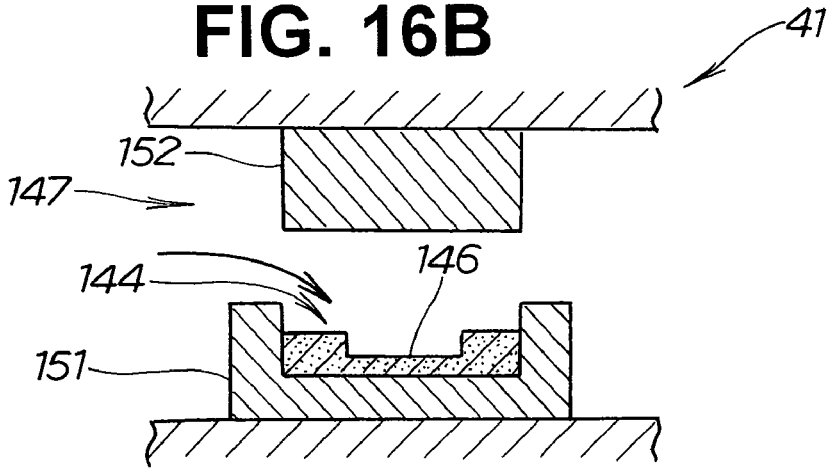

Referring to FIG. 16B, the seventh billet 144 having a temperature of 580° C. or above is set in a die assembly 147 as shown by an arrow and is formed into a specific shape by the operation of a press 41 having the die assembly 147 mounted therein.

The die assembly 147 has a lower die 151, an upper punch 152 and a temperature control device not shown. The die assembly 147 is used to apply pressure to the seventh billet 144 at or above 580° C. with the pressure P, the pressure applying velocity Vp and the specific descending stroke to form the seventh product 121 (see FIG. 13C).

Figure 16C:
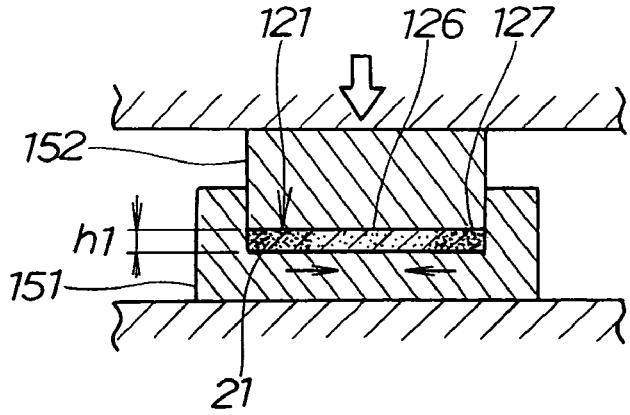

Then, the upper punch 152 is moved to the lower limit of its stroke as shown in FIG. 16C, whereby the seventh product 121 is obtained.

More specifically, during the process in which pressure is applied to the seventh billet 144, the disk 145 begins to break down and the aluminum alloy 22 in the disk 145 flows under pressure inwardly (in the directions of arrows) through among the particles of the aggregate 21.

On the other hand, the aggregate 21 is destroyed by the contact and impingement of the particles thereof and breaks down under pressure into a smaller aggregate or alumina ($Al_2O_3$) particles, and nearly all of them stay without moving toward the concavity 146. As a result, the middle portion 126 of the seventh product 121 has a ceramic volume content Vf or Vm7 of about 20% and its edge portion 127 has a ceramic volume content Vf or Ve7 of about 28%.

h1 denotes the height of the billet after pressure forming and corresponds to the sheet thickness of the seventh product 121. The compression ratio Rh of the middle portion 126 of the seventh product 121 is Rh=Hk/h1. The compression ratio Rh of its edge portion 127 is Rh=t7/h1, or below 1.

According to the seventh forming method, therefore, the seventh product 121 has a compression ratio Rh differing from its middle portion 126 to its edge portion 127.

Thus, as the fifth, sixth or seventh forming method according to present invention employs the fifth, sixth or seventh billet having a height differing from one portion to another when forming the fifth, sixth or seventh product with a compression ratio Rh differing from one portion to another, the mere closure of the die assembly is sufficient to form a fifth, sixth or seventh product having a ceramic volume content differing from one portion to another without altering the height h1 of the billet after pressure forming, thereby permitting an easier forming job.

An eighth method of forming an eighth product will now be described with reference to FIGS. 17A to 17E. The steps of preparing a composite material and heating a billet are identical to those in the first method and will not be described any more.

Figure 17A:
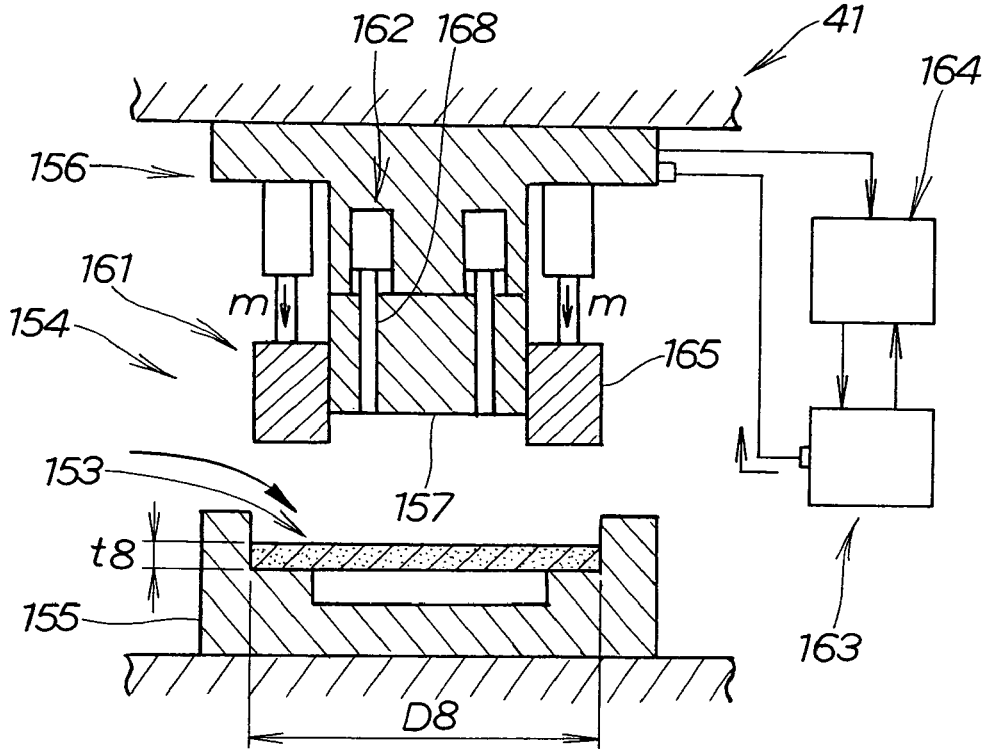
FIGS. 17A to 17E are diagrams showing the pressure forming step in an eighth forming method according to present invention employing a split die assembly and an eighth product formed by that method.

Referring to FIG. 17A, the step of forming a billet in the eighth forming method employs a metal-based composite material 27 (see FIG. 2C) or an aluminum-based composite billet 66 (see FIG. 5C) to form an eighth billet 153. The eighth billet 153 is a disk having a diameter D8 and a thickness t8.

The pressure applying step in the eighth forming method employs a split die assembly 154. The split die assembly 154 has a lower die 155, a split upper punch 156 and a temperature control device not shown.

The split upper punch 156 has a centrally mounted inner punch 157, an outer punch mechanism 161 situated outside the inner punch 157 and a boring mechanism 162 provided in the inner punch 157.

The outer punch mechanism 161 and the boring mechanism 162 are connected to a hydraulic unit 163 and controlled in accordance with information from a control unit 164 containing pre-set forming conditions.

The eighth billet 153 having a temperature of 580° C. or above is set in the split die assembly 154 as shown by an arrow and its forming is started by the operation of a press 41 having the split upper punch 156 mounted therein.

An outer punch 165 in the outer punch mechanism 161 is first lowered to its lower limit as shown by arrows m. Then, the split upper punch 156 is lowered by the press 41.

Figure 17B:
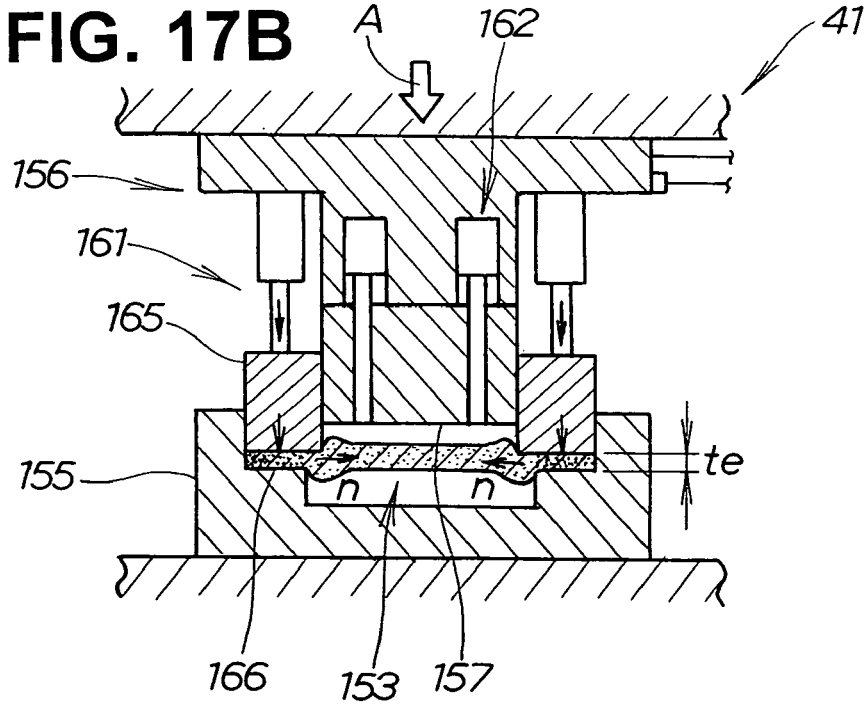

The split upper punch 156 is lowered to make the outer punch 165 contact the edge portion 166 of the eighth billet 153 and form the edge portion 166 into a thickness te, while the lowering of the press 41 (in the direction of an arrow A) is continued, as shown in FIG. 17B. In the meantime, the aluminum alloy 22 in the edge portion 166 flows toward the center of the eighth billet 153, as shown by arrows n. The edge portion 166 has a higher ceramic volume content Vf than the ceramic volume content of the metal-based composite material 27 (see FIG. 2C). The edge portion 166 has a compression ratio Rh=t8/te, for example, 6 or above.

Then, forming by the inner punch 157 is started.

Figure 17C:
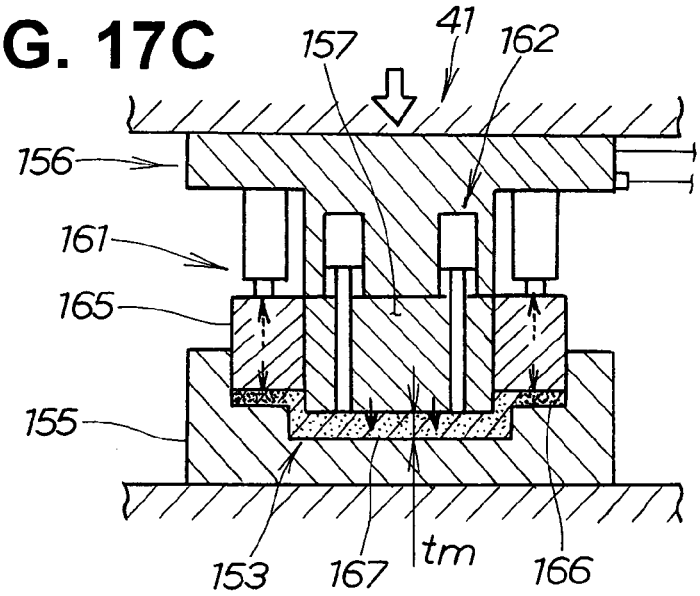

The inner punch 157 is lowered by the press 41 to form the middle portion 167 of the eighth billet 153 into a concave shape so that the middle portion 167 may have a thickness tm, as shown in FIG. 17C. The outer punch mechanism 161 is retracted (in the direction of arrows in broken lines) synchronously with the lowering speed of the press 41, so that the outer punch 165 may not move down, but may remain stationary and continue to hold down the edge portion 166.

The thickness tm of the middle portion 167 obtained after pressure forming is substantially equal to its thickness t8 owned before pressure forming, and the compression ratio Rh of the middle portion 167 is Rh=t8/tm, or about 1. The ceramic volume content Vf of the middle portion 167 obtained after pressure forming is naturally substantially equal to the ceramic volume content of the eighth billet 153.

Then, holes are made in the middle portion 167 by the boring mechanism 162.

Figure 17D:
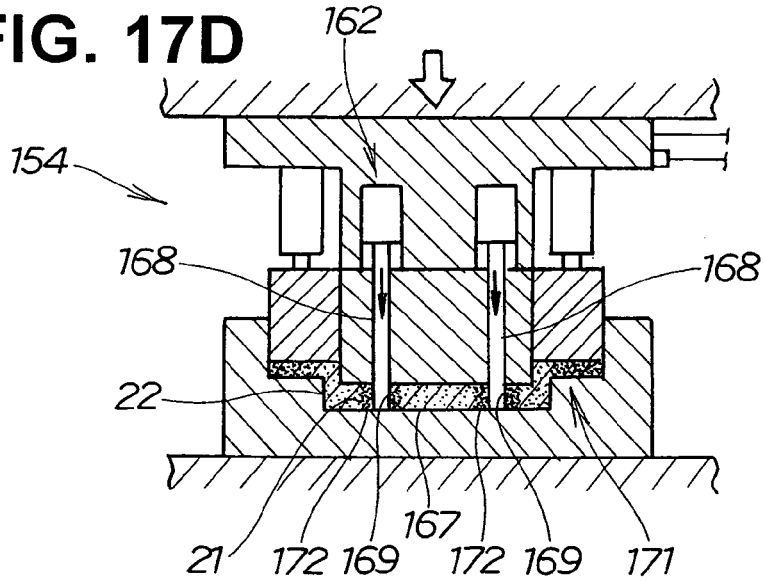

The boring mechanism 162 has four pins 168 forced into the middle portion 167 as shown by arrows to make four mounting holes 169 therein and thereby complete an eighth product 171, as shown in FIG. 17D.

When the four pins 168 are forced into the middle portion 167, the flow of the aluminum alloy 22 and the movement of the aggregate 21 occur in portions 172 pressed by the pins 168, whereby the pressed portions 172 have a high ceramic volume content. This gives increased strength to the portions around the mounting holes 169.

Figure 17E:
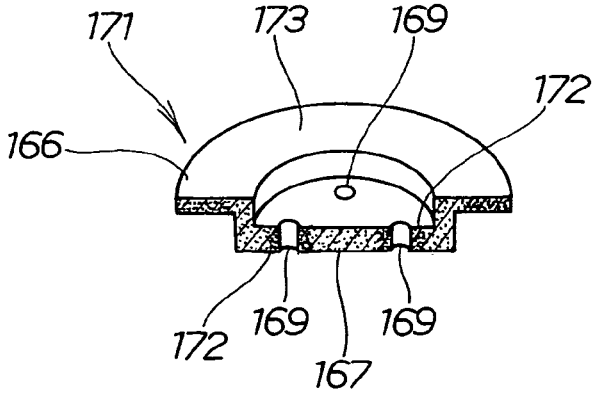

The eighth product 171 is, for example, a brake disk as shown in FIG. 17E. The brake disk has increased strength in those portions around the mounting holes 169 on which a large force bears when it is bolted to a hub. Its portions 172 pressed around the mounting holes 169 are high in strength as compared with the strength (Young's modulus Eb) of the metal-based composite material 27 (see FIG. 2C).

Its sliding portion 173 is superior in strength and wear resistance to the metal-based composite material 27 (see FIG. 2C).

The use of the split die assembly 154 enables the eighth product 171 to have a compression ratio Rh differing from its edge portion 166 to its middle portion 167 and thereby a ceramic volume content differing from one portion to the other even if the eighth billet 153 may not have a varying shape.

Two examples will now be given to describe other forming methods employing the split die assembly 154.

According to the first example, pressure is applied first by the inner punch 157 to form a middle portion 167 having a high ceramic volume content and then by the outer punch mechanism 161 to form an edge portion 166 having a finished shape. The product is substantially equal in shape to the second product 68 (brake disk) shown in FIG. 6. Its ceramic volume content likewise decreases gradually from its middle portion 167 to its edge portion 166.

According to the second example, pressure is first applied by the inner punch 157 to form a middle portion 167 having a high ceramic volume content.

Then, the mounting holes 169 are made by a plurality of pins 168, while the portions 172 thereby pressed have a high ceramic volume content. Finally, pressure is applied by the outer punch mechanism 161 to form an edge portion 166 having a finished shape. This makes it possible to form portions of high strength around the mounting holes 169 in the second product 68 (brake disk) shown in FIG. 8C.

The use of the split die assembly 154 as described makes it possible for the outer punch 165 to determine the ceramic volume content of the edge portion 166 of the eighth billet 153, for the inner punch 157 to determine the ceramic volume content of the middle portion 167 of the eighth billet 153 and for the four pins 168 of the boring mechanism 162 to determine the ceramic volume content of the portions 172 thereby pressed around the four mounting holes 169 made in the middle portion 167, even if the eighth billet 153 may be uniform in thickness. Thus, it is possible to form many portions having a different ceramic volume content from the remainder.

A ninth method of forming a ninth product of a metal-based composite material according to present invention will now be described with reference to FIGS. 18A to 18D. The steps of preparing a composite material, forming a billet and heating it are identical to those in the second method shown in FIG. 7 and will not be described any more.

The ninth forming method is characterized by employing a partly heat-insulated die assembly 78B having a ceramic film formed on a part thereof.

Figure 18A:
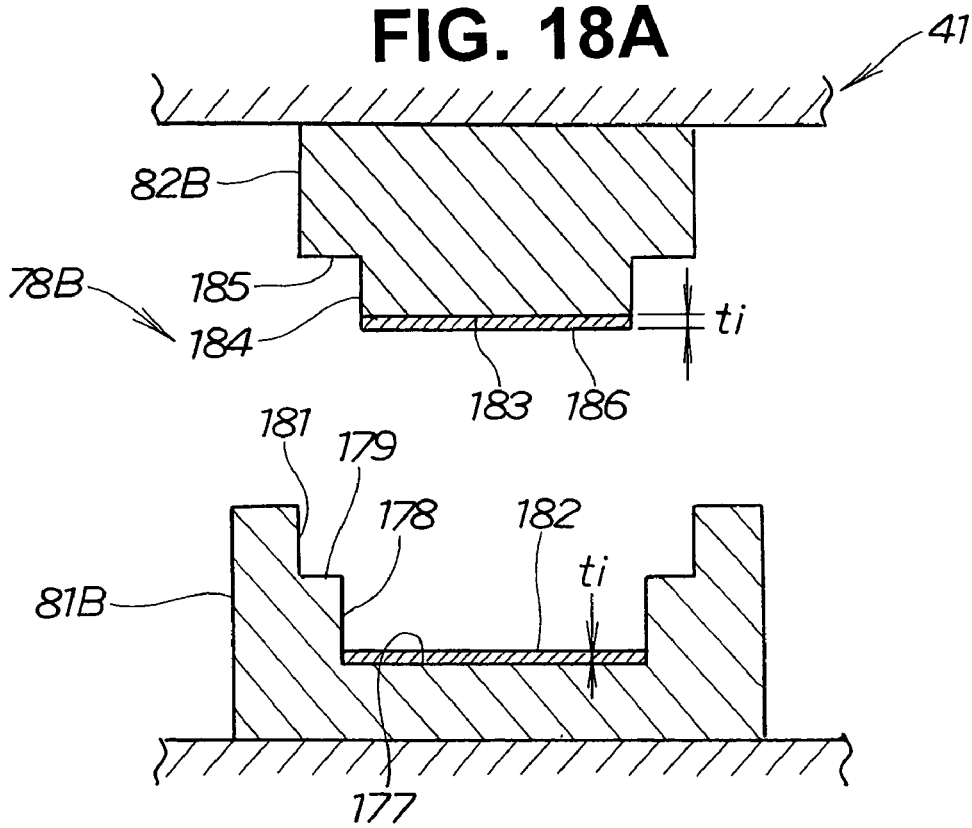
FIGS. 18A to 18D are diagrams showing the pressure forming step in a ninth forming method according to present invention.

The partly heat-insulated die assembly 78B shown in FIG. 18A has a lower die 81B, an upper punch 82B and a temperature control device not shown, and is equal in dimensions to the die assembly 78 used by the second method (see FIG. 7). Alloy tool steel is, for example, selected as a material for the body of the partly heat-insulated die assembly 78B.

The lower die 81B has a first, a second, a third and a fourth die surface 177, 178, 179 and 181 formed for contacting a billet. The first die surface 177 has a ceramic film 182 formed thereon by plasma spray coating for its heat insulation.

The ceramic film 182 is mainly intended for heat insulation and is of a material of low thermal conductivity.

The spray coating material for the ceramic film 182 is zirconia ($ZrO_2$). Aluminum silicates ($Al_2O_3.SiO_2$) can be mentioned as spray coating materials other than zirconia. Mullite ($3Al_2O_3 \cdot 2SiO_2$) is available as typical aluminum silicate.

The ninth forming method employs a ceramic film 182 having a thickness ti of 100 to 1,000 μm.

If the film thickness is less than 100 um, the film is so thin and so low in heat-insulating property that when a billet 77B (see FIG. 18B) having a given temperature is set on the first die surface 177, the billet is quenched and has a thick quenched layer formed in its surface layer (for example, having a depth of 0.5 mm). As a result, the surface layer of the product and its deep layer (midway across its thickness) have a great variation in ceramic volume content Vf therebetween. The variation is a difference between the maximum and minimum values.

If the film thickness exceeds 1,000 μm, it exhibits the maximum heat-insulating property within the time for which the billet remains in contact with the die assembly, and the quenched layer does not have a reduced thickness. When the billet having a given temperature is set, there is no change in the thickness of the quenched layer formed in the surface layer of the billet (for example, having a depth of 0.5 mm). Thus, the quenched layer is of the smallest thickness. Accordingly, no further reduction is possible in the variation in ceramic volume content Vf between the surface layer of the product and its deep layer (midway across its thickness).

The film thickness ti is the thickness obtained upon completion, for example, after grinding or polishing, or is 500 μm.

It is also possible to use a sheet, for example, of ceramics (aluminum silicate) for heat insulation without relying on any spray coated film. The sheet is of the same thickness with the film.

The upper punch 82B has a first, a second and a third punch surface 183, 184 and 185 formed for contacting the billet. The first punch surface 183 has a ceramic film 186 formed thereon by plasma spray coating for its heat insulation. The ceramic film 186 is equal to the ceramic film 182 formed on the lower die 8 1B and is not described any more.

Figure 18B:
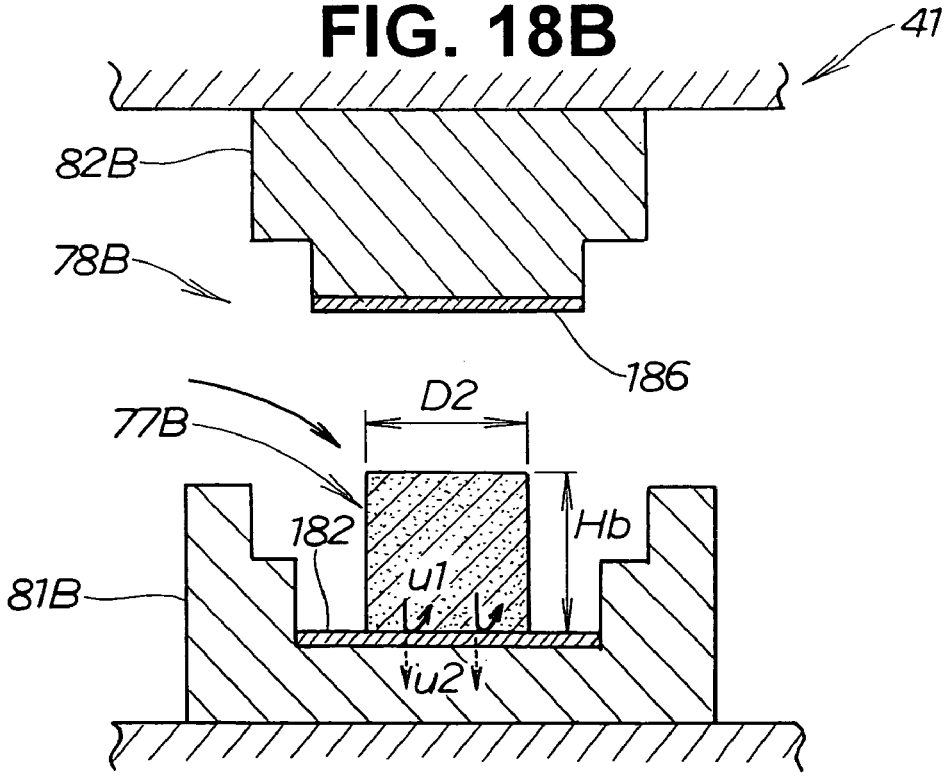

The step of forming a billet in the ninth forming method employs a metal-based composite material 27 (see FIG. 2C) or an aluminum-based composite billet 66 (see FIG. 5C) to form a ninth billet 77B as shown in FIG. 18B. The ninth billet 77B is equal to the second billet 77 shown in FIG. 7 and has a diameter D2 and a height Hb.

In the step of pressure application, the ninth billet 77B is held at or above 580° C. and set in the partly heat- insulated die assembly 78B having the ceramic films formed thereon, as shown in FIG. 18B. A press 41 having the partly heat-insulated die assembly 78B mounted therein is operated to start forming.

When the ninth billet 77B is set on the ceramic film 182 of the lower die 81B during the step of pressure application, the ceramic film 182 insulates the heat of the ninth billet 77B as shown by arrows u1 and u2, so that the ninth billet 77B hardly has a quenched surface layer.

Figure 18C:
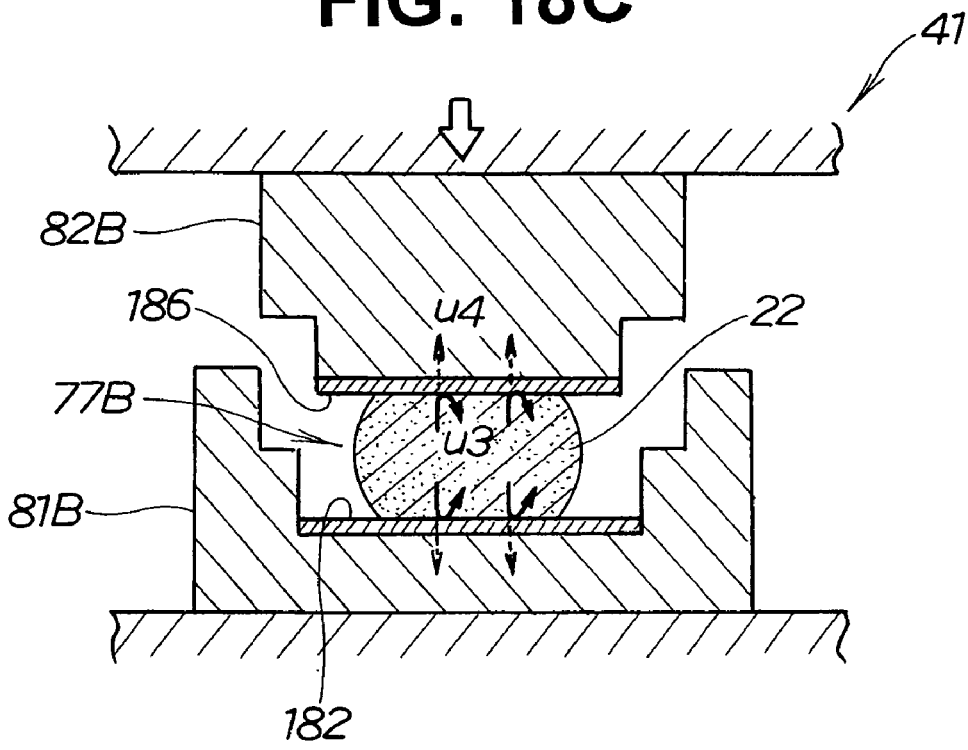

The upper punch 82B is lowered to have its ceramic film 186 contact the ninth billet 77B and apply pressure to the ninth billet 77B, as shown in FIG. 18C.

When the upper punch 82B has its ceramic film 186 contact the ninth billet 77B during the step of pressure application, the ceramic film 186 insulates the heat of the ninth billet 77B as shown by arrows u3 and u4, so that the ninth billet 77B hardly has a quenched surface layer.

During the process of pressure application to the ninth billet 77B, the aluminum alloy 22 having a temperature of 580° C. or above flows through among the particles of the aggregate 21. More particularly, the ninth billet 77B has only a thin quenched layer formed in its surface layer and the aluminum alloy 22 in its surface layer is not lowered in fluidity, but can flow laterally by overcoming any small resistance to its flow substantially like the aluminum alloy 22 in the inner layer.

Figure 18D:
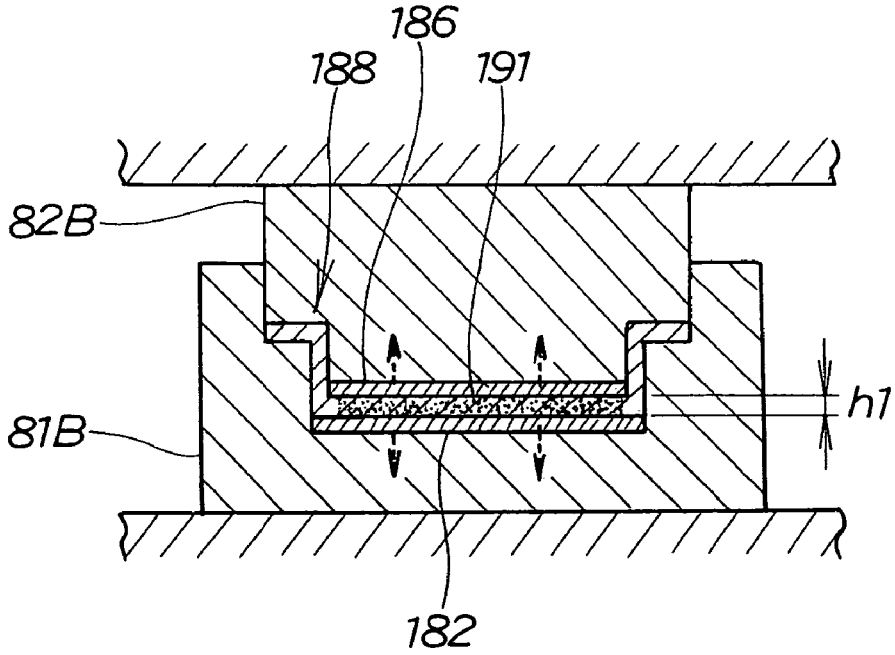

The upper punch 82B is further lowered and as soon as it has reached the lower limit of its descending stroke, a ninth product 188 is completed, as shown in FIG. 18D.

During the process of pressure application to the ninth billet 77B as shown in FIG. 18C, any drop in temperature of the ninth billet 77B is restrained by the ceramic films 182 and 186, and a fastening portion 191 has only a small difference in ceramic volume content Vf between its surface and inner layers.

The partly heat-insulated die assembly 78B employed by the method of forming the ninth product 188 of a metal-based composite material is a die assembly having the ceramic film 182 formed on the first die surface 177 of the lower die 81B contacting the ninth billet 77B and the ceramic film 186 formed on the first punch surface 183 of the upper punch 82B contacting the ninth billet 77B, as shown in FIG. 18A. Therefore, the partly heat-insulated die assembly 78B is lower in thermal conductivity than any die assembly not having any such heat insulation, and makes it possible to reduce any difference in ceramic volume content between the surface and inner layers of any product formed from a metal-based composite material, as compared with any die assembly not controlled in thermal conductivity.

A tenth method of forming a tenth product of a metal-based composite material according to present invention will now be described with reference to FIGS. 19A to 19D. Parts and materials equivalent to those employed by the ninth method as shown in FIGS. 18A to 18D are shown by the same symbols and will not be described any more. The tenth forming method is characterized by employing a wholly heat-insulated die assembly 78C having a ceramic film formed thereon as a whole.

Figure 19A:
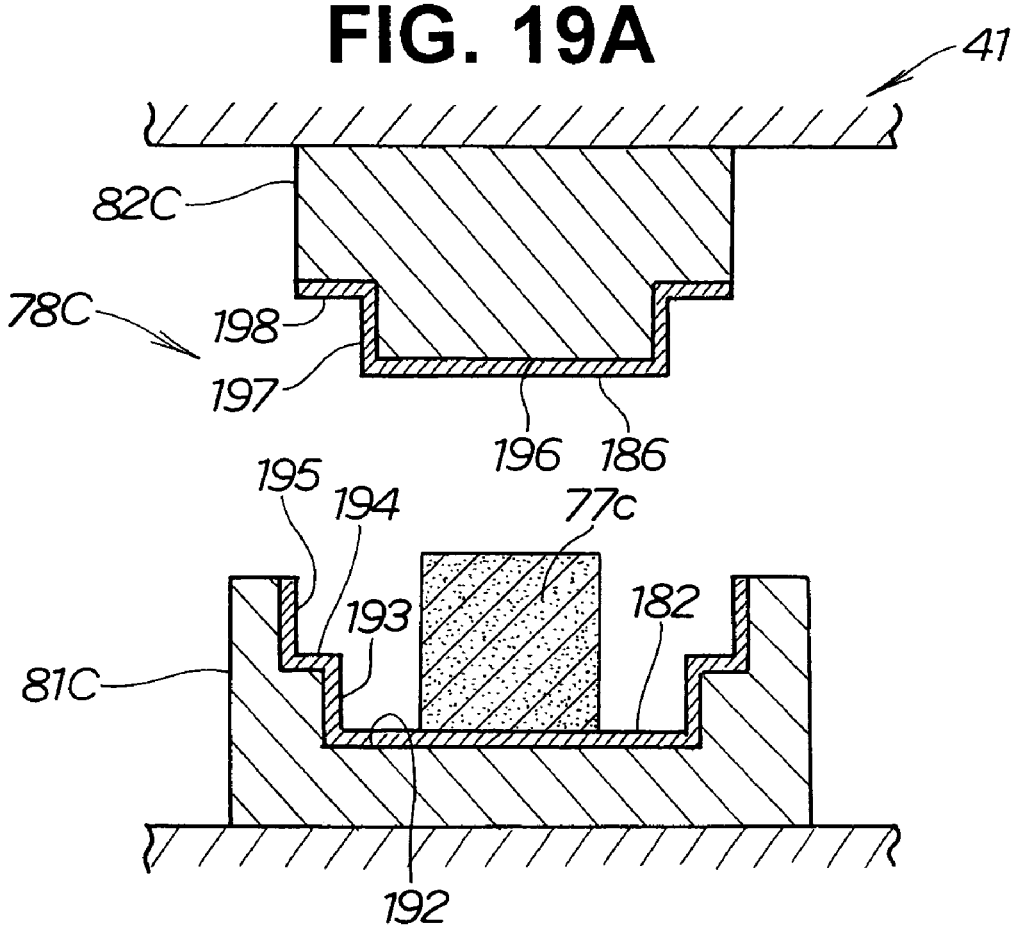
FIGS. 19A to 19D are diagrams showing the pressure forming step in a tenth forming method according to present invention.

The wholly heat-insulated die assembly 78C shown in FIG. 19A has a lower die 81C, an upper punch 82C and a temperature control device not shown. The material for the body of the wholly heat-insulated die assembly 78C is, for example, alloy tool steel.

The lower die 81C has a first, a second, a third and a fourth die surface 192, 193, 194 and 195 formed for contacting a billet. The first, second, third and fourth die surfaces 192, 193, 194 and 195 have a ceramic film 182 formed thereon by plasma spray coating for their heat insulation.

The upper punch 82C has a first, a second and a third punch surface 196, 197 and 198 formed for contacting the billet and the first, second and third punch surfaces 196, 197 and 198 have a ceramic film 186 formed thereon by plasma spray coating for their heat insulation.

In the step of pressure application, the tenth billet 77C equivalent to the ninth billet 77B shown in FIG. 18B is held at or above 580° C. and set in the wholly heat-insulated die assembly 78C having the ceramic films formed wholly thereon, and a press 41 having the wholly heat-insulated die assembly 78C mounted therein is operated to start forming.

Figure 19B:
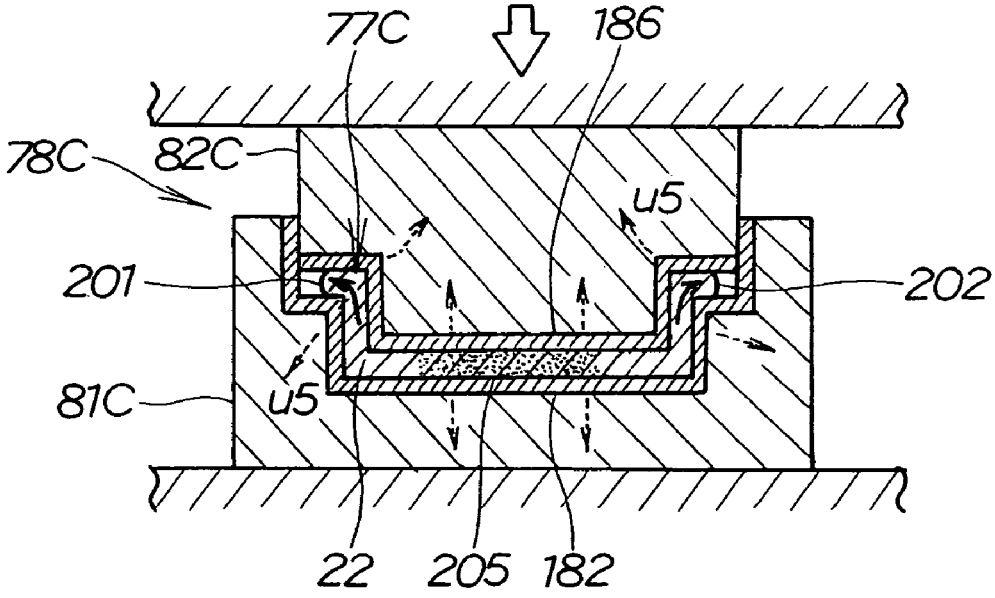

During the process of pressure application to the tenth billet 77C as shown in FIG. 19B, the aluminum alloy 22 flowing out at ends 201 (shown at left) and 202 (shown at right) has its heat insulated by the ceramic films 182 and 186 in the directions of arrows u5 and hardly any increase in resistance to its flow occurs from its temperature drop.

Figure 19C:
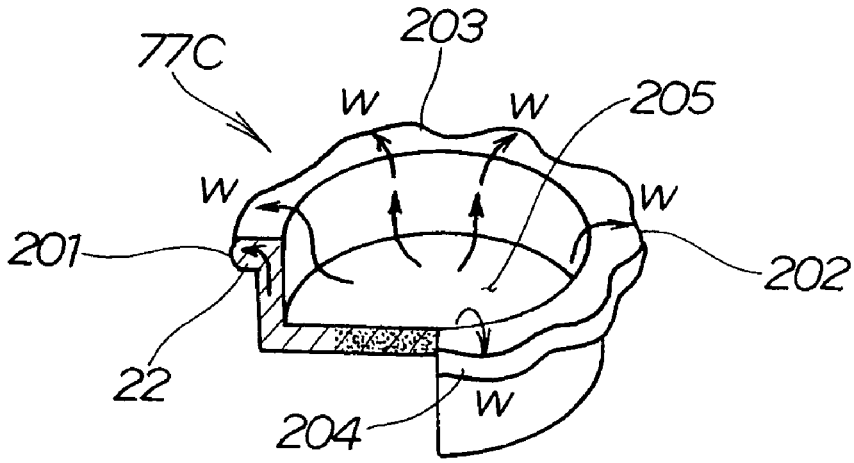

FIG. 19C shows the tenth billet 77C in its process of pressure forming as shown in FIG. 19B. At its flowing ends 201, 202, 203 and 204, the aluminum alloy 22 has its heat insulated by the ceramic films 182 and 186 formed on the wholly heat-insulated die assembly 78C shown in FIG. 19B and hardly any increase in resistance to its flow occurs from its temperature drop. Consequently, the aluminum alloy 22 in both of the surface layers of the fastening portion 205 shown in FIG. 19C flows as shown by arrows w like the aluminum alloy 22 in its inner layer. Therefore, the fastening portion 205 has only a smaller difference in ceramic volume content Vf between its surface and inner layers.

Figure 19D:
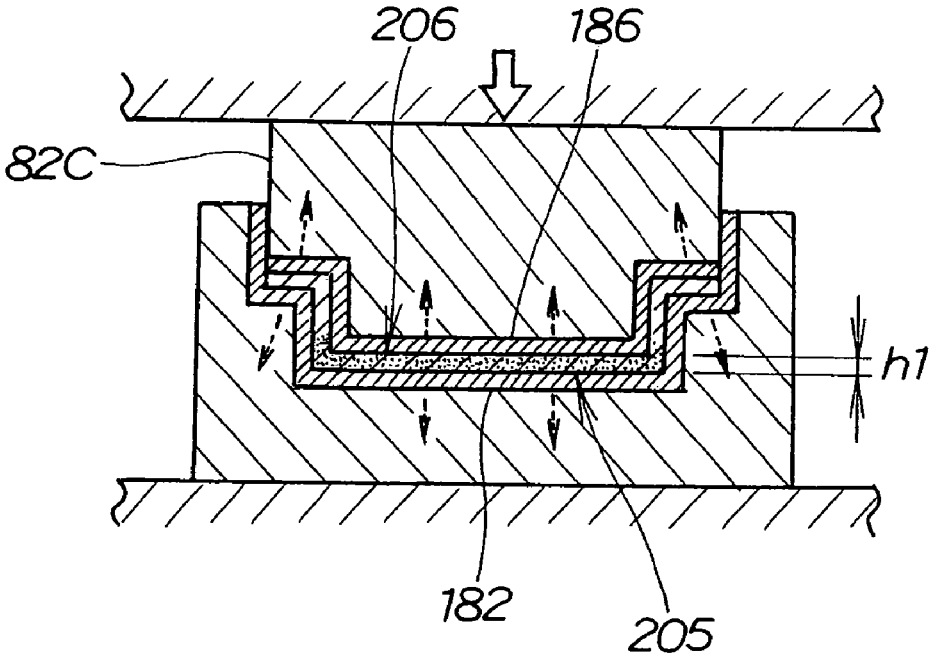

The upper punch 82C is further lowered and as soon as it has reached the lower limit of its descending stroke, a tenth product 206 is completed, as shown in FIG. 19D.

During the process of pressure application to the tenth billet, the ceramic films 182 and 186 restrain any temperature drop at the flowing ends of the tenth billet and therefore, the fastening portion 205 has a smaller difference in ceramic volume content Vf between its surface and inner layers than in any die assembly not having any ceramic film 182 or 186.

Figure 20:
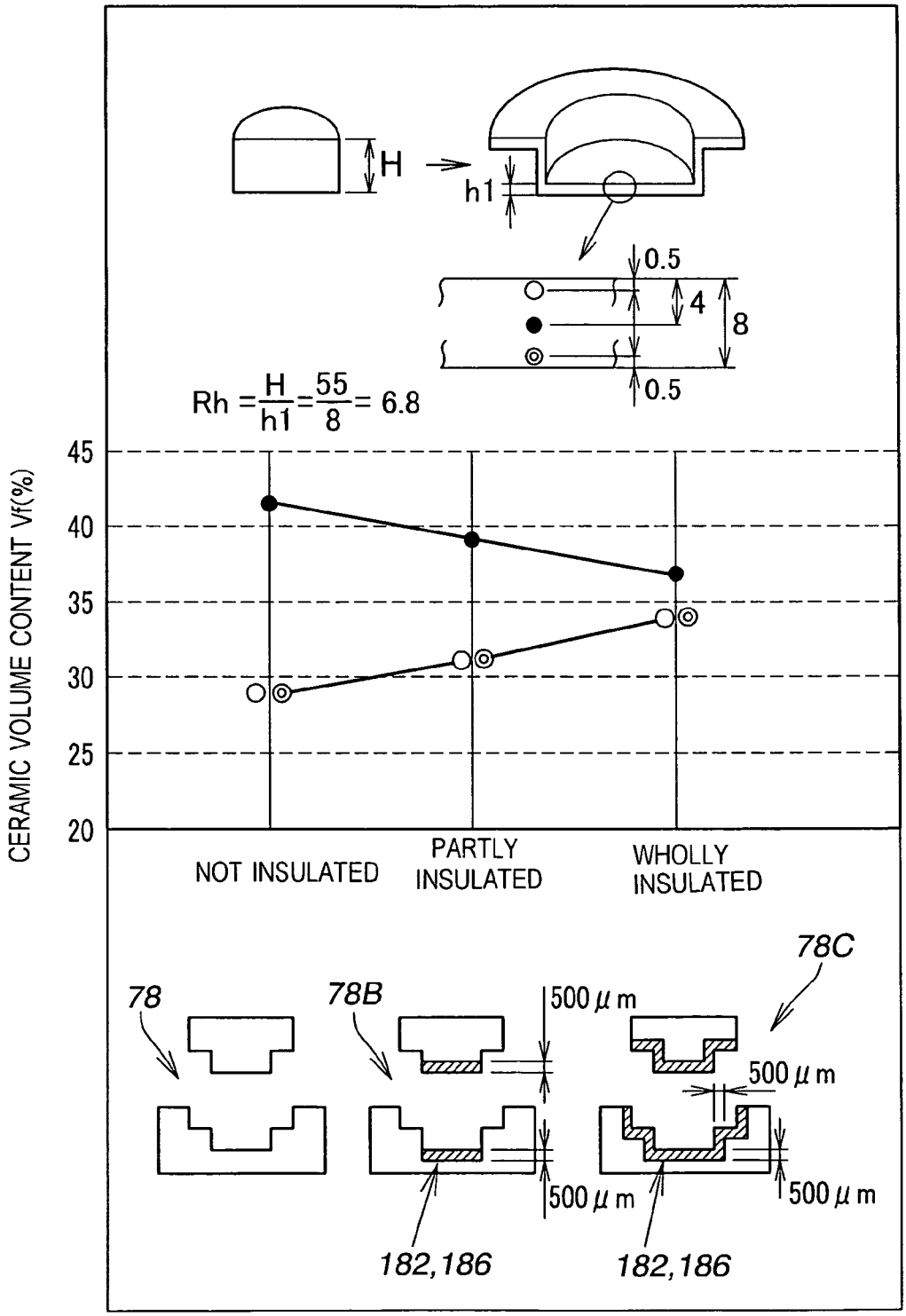
FIG. 20 is a graph showing the relation in ceramic volume content of products formed by employing a die assembly not having any heat insulation, a die assembly having heat insulation in a part of the area contacting a billet and a die assembly having heat insulation in the whole area contacting a billet.
Figure 21:
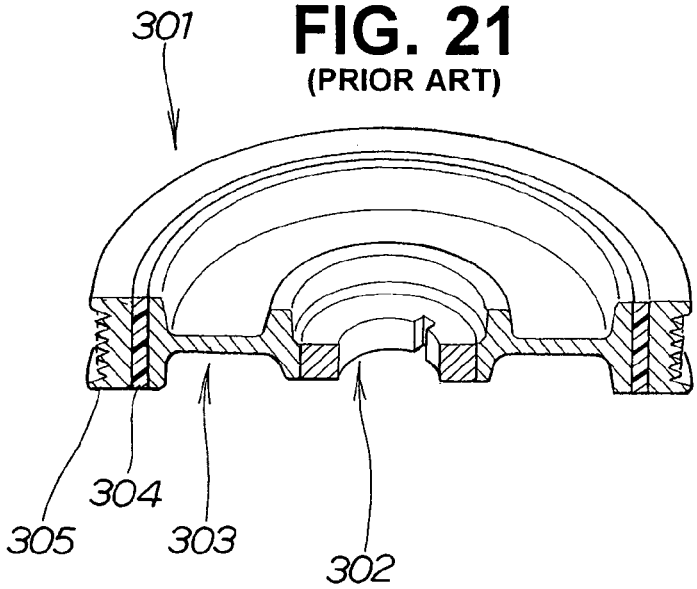
FIG. 21 (PRIOR ART)
FIG. 21 is a diagram showing a pulley formed by employing a composite material according to the prior art as a part thereof.
Figure 22A:
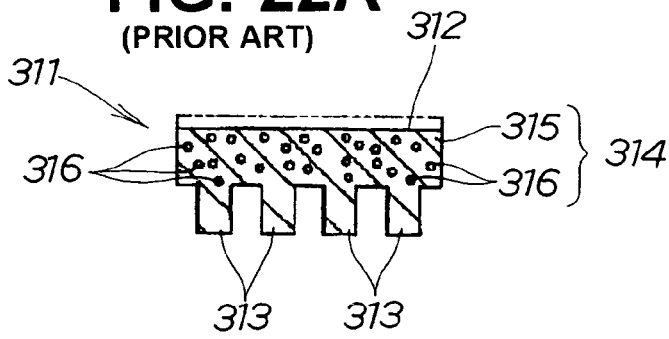
FIG. 22A (PRIOR ART)
FIGS. 22A to 22C are diagrams showing a method of manufacturing a composite material according to the prior art.
Figure 22B:
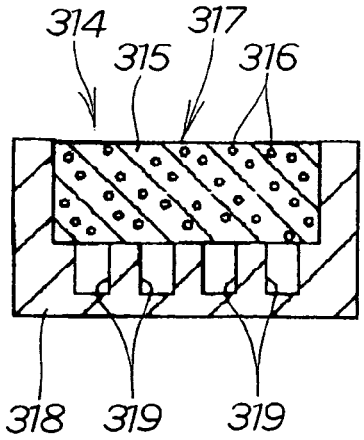
FIG. 22B (PRIOR ART)
Figure 22C:
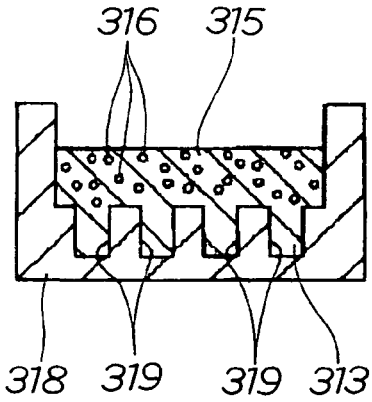
FIG. 22C (PRIOR ART)

FIG. 20 is a graph showing the relation between the ceamic volume contents of products formed by a die assembly not having any heat insulation and by a die assembly having heat insulation according to the forming method of present invention. The horizontal axis represents a die assembly 'Not insulated', 'Partly insulated' or 'Wholly insulated', and the vertical axis represents the ceramic volume content Vf. The forming conditions are a pressure P of 650 kg/cm$^2$ as expressed by the surface pressure against the projected area of the billet, a pressure applying velocity Vp of about 130 mm/sec., a billet heating temperature of 580° C. or above, a compression ratio Rh of 6.8, a die temperature of 300° C. and a ceramic film thickness of 500 μm as formed on the die assembly by spray coating.

○ indicates the ceramic volume content Vf of one of the surface layers of the fastening portion at a depth of 0.5 mm.

⊙ indicates the ceramic volume content Vf of the other surface layer of the fastening portion at a depth of 0.5 mm.

● indicates the ceramic volume content Vf of the inner layer of the fastening portion at a depth of 4 mm midway of its thickness.

'Not insulated' is a die assembly not having any heat insulation, and corresponds to the die assembly 78 shown in FIG. 7.

'Partly insulated' is a die assembly having ceramic films formed only in the center of its portions contacting a billet, and corresponds to the die assembly 78B shown in FIG. 18A.

'Wholly insulated' is a die assembly having ceramic films formed on the whole area of its portions contacting a billet, and corresponds to the die assembly 78C shown in FIG. 19A.

The product formed by the die assembly not insulated has a ceramic volume content Vf of 28 to 42% and a difference of 14 therebetween (between the maximum and minimum values).

The product formed by the partly insulated die assembly has a ceramic volume content Vf of 31 to 39% and a difference reduced to 8 therebetween.

The product formed by the wholly insulated die assembly has a ceramic volume content Vf of 33 to 38% and a difference reduced further to 5 therebetween.

INDUSTRIAL APPLICABILITY

The products of a metal-based composite material formed by the methods according to present invention are applicable not only to brake disks for vehicles, but also to parts or members for various kinds of industrial machines, since they differ in strength from one portion to another.

The invention claimed is:

1. A method of forming a product of a metal-based composite material, comprising the steps in the order named of:

preparing a billet of a metal-based composite material by mixing a metal matrix and particles of ceramic reinforcing material;

heating the billet to a specific temperature, the specific temperature being equal to or above the solidus temperature of the metal matrix and a liquid phase being present in the metal matrix; and pressure forming the heated billet in a die assembly, into a formed product by reciprocating a punch relative to a die, wherein the billet and the punch and die are configured such that the billet while being pressure formed has a compression ratio H/h 1 differing from one portion of the formed product to another to thereby give the formed product a ceramic volume content differing from one portion to another, where H is the height of the billet prior to pressure forming and h 1 is a thickness of the formed product and corresponds to a height of the billet after pressure forming the formed product containing the particles of the ceramic reinforcing material distributed over the entire region thereof, wherein during the pressure forming, the punch advances toward the die at a speed not exceeding 300 mm/sec to control the ceramic volume content of the formed product and an advancing movement of the punch toward the die at the speed not exceeding 300 mm/sec causes the metal matrix to flow out from the heated billet into a space defined between the punch and the die while nearly all of the particles of the ceramic reinforcing material are caused to move in the same direction as the advancing movement of the punch, the remainder of the particles of the ceramic reinforcing material being forced by the metal matrix to flow in the same direction as the metal matrix, and wherein the ceramic volume content of the formed product is directly proportional to the compression ratio of the billet.

2. The method of claim 1, wherein the billet has a height varying from one portion to another.

3. The method of claim 1, wherein the pressure forming employs a split die assembly.

4. The method of claim 1, wherein the pressure forming employs a die assembly having heat insulation in its portions contacting the billet.

5. The method of claim 1, wherein an aluminum alloy is employed as the matrix, and an alumina aggregate as the ceramic.

6. The method of claim 1, wherein the step of heating is carried out for heating the billet to or above 580° C.

7. The method of claim 2, wherein an aluminum alloy is employed as the matrix, and an alumina aggregate as the ceramic.

8. The method of claim 3, wherein an aluminum alloy is employed as the matrix, and an alumina aggregate as the ceramic.

9. The method of claim 4, wherein an aluminum alloy is employed as the matrix, and an alumina aggregate as the ceramic.

10. The method of claim 1, wherein the advancing speed of the punch toward the die during the pressure forming is not less than 5 mm/sec.

* * * * *